US010724263B2

(12) United States Patent
Stiles, Jr. et al.

(10) Patent No.: US 10,724,263 B2
(45) **Date of Patent: *Jul. 28, 2020**

(54) SAFETY VACUUM RELEASE SYSTEM

(71) Applicants: Pentair Water Pool and Spa, Inc., Cary, NC (US); Danfoss Power Electronics A/S, Graasten (DK)

(72) Inventors: Robert W. Stiles, Jr., Cary, NC (US); Lars Hoffmann Berthelsen, Kolding (DK)

(73) Assignees: PENTAIR WATER POOL AND SPA, INC., Cary, NC (US); DANFOSS POWER ELECTRONICS A/S, Graasten (DK)

( * ) Notice: Subject to any disclaimer, the term of this patent is extended or adjusted under 35 U.S.C. 154(b) by 282 days.

This patent is subject to a terminal disclaimer.

(21) Appl. No.: 15/652,097

(22) Filed: Jul. 17, 2017

(65) Prior Publication Data

US 2018/0003181 A1 Jan. 4, 2018

Related U.S. Application Data

(60) Continuation of application No. 14/095,911, filed on Dec. 3, 2013, now Pat. No. 9,726,184, which is a (Continued)

(51) Int. Cl.
*F04B 49/06* (2006.01)
*E04H 4/12* (2006.01)
(Continued)

(52) U.S. Cl.
CPC ..... *E04H 4/1245* (2013.01); *E04H 4/1209* (2013.01); *E04H 4/16* (2013.01);
(Continued)

(58) Field of Classification Search
CPC ..... E04H 4/1245; E04H 4/16; E04H 4/1209; F04B 49/065; F04B 49/106; F04B 49/10; F04B 2203/0201; F04B 2203/0202
See application file for complete search history.

(56) References Cited

U.S. PATENT DOCUMENTS 981,213 A 1/1911 Mollitor
1,993,267 A 3/1935 Ferguson
(Continued)

FOREIGN PATENT DOCUMENTS

AU 3940997 2/1998
AU 2005204246 A1 3/2006
(Continued)

OTHER PUBLICATIONS

U.S. Patent Trial and Appeal Board's Rule 36 Judgment, without opinion, in Case No. 2016-2598, dated Aug. 15, 2017, pp. 1-2.
(Continued)

*Primary Examiner* — Charles G Freay
(74) *Attorney, Agent, or Firm* — Husch Blackwell LLP

(57) ABSTRACT

Some embodiments of the invention provide a pumping system for at least one aquatic application. The pumping system includes a pump, a motor coupled to the pump, a user interface associated with the pump designed to receive input instructions from a user, and a controller in communication with the motor. The controller determines a power parameter associated with the motor and compares the power parameter to a predetermined threshold value. The controller triggers a safety vacuum release system based on the comparison of the power parameter and the threshold value.

24 Claims, 7 Drawing Sheets

Related U.S. Application Data continuation of application No. 13/350,167, filed on Jan. 13, 2012, now Pat. No. 8,602,743, which is a division of application No. 12/572,774, filed on Oct. 2, 2009, now Pat. No. 8,313,306.

(60) Provisional application No. 61/102,935, filed on Oct. 6, 2008.

(51) Int. Cl.
*F04B 49/10* (2006.01)
*E04H 4/16* (2006.01)

(52) U.S. Cl.
CPC ..... *F04B 49/065* (2013.01); *F04B 49/10* (2013.01); *F04B 2203/0201* (2013.01); *F04B 2203/0202* (2013.01)

(56) References Cited

U.S. PATENT DOCUMENTS 2,238,597 A 4/1941 Page
2,458,006 A 1/1949 Kilgore
2,488,365 A 11/1949 Abbott et al.
2,494,200 A 1/1950 Ramqvist
2,615,937 A 10/1952 Ludwig
2,716,195 A 8/1955 Anderson
2,767,277 A 10/1956 Wirth
2,778,958 A 1/1957 Hamm et al.
2,881,337 A 4/1959 Wall
3,116,445 A 12/1963 Wright
3,191,935 A 6/1965 Uecker
3,204,423 A 10/1965 Resh, Jr.
3,213,304 A 10/1965 Landerg et al.
3,226,620 A 12/1965 Elliott et al.
3,227,808 A 1/1966 Morris
3,291,058 A 12/1966 McFarlin
3,316,843 A 5/1967 Vaughan
3,481,973 A 12/1969 Wygant
3,530,348 A 9/1970 Connor
3,558,910 A 1/1971 Dale et al.
3,559,731 A 2/1971 Stafford
3,562,614 A 2/1971 Gramkow
3,566,225 A 2/1971 Paulson
3,573,579 A 4/1971 Lewus
3,581,895 A 6/1971 Howard et al.
3,593,081 A 7/1971 Forst
3,594,623 A 7/1971 LaMaster
3,596,158 A 7/1971 Watrous
3,613,805 A 10/1971 Lindstad
3,624,470 A 11/1971 Johnson
3,634,842 A 1/1972 Niedermeyer
3,652,912 A 3/1972 Bordonaro
3,671,830 A 6/1972 Kruger
3,726,606 A 4/1973 Peters
1,061,919 A 5/1973 Miller
3,735,233 A 5/1973 Ringle
3,737,749 A 6/1973 Schmit
3,753,072 A 8/1973 Jurgens
3,761,750 A 9/1973 Green
3,761,792 A 9/1973 Whitney
3,777,232 A 12/1973 Woods et al.
3,777,804 A 12/1973 McCoy
3,778,804 A 12/1973 Adair
3,780,759 A 12/1973 Yahle et al.
3,781,925 A 1/1974 Curtis
3,787,882 A 1/1974 Fillmore
3,792,324 A 2/1974 Suarez
3,800,205 A 3/1974 Zalar
3,814,544 A 6/1974 Roberts et al.
3,838,597 A 10/1974 Montgomery et al.
3,867,071 A 2/1975 Hartley
3,882,364 A 5/1975 Wright
3,902,369 A 9/1975 Metz
3,910,725 A 10/1975 Rule
3,913,342 A 10/1975 Barry
3,916,274 A 10/1975 Lewus
3,941,507 A 3/1976 Niedermeyer
3,949,782 A 4/1976 Athey et al.
3,953,777 A 4/1976 McKee
3,956,760 A 5/1976 Edwards
3,963,375 A 6/1976 Curtis
3,972,647 A 8/1976 Niedermeyer
3,976,919 A 8/1976 Vandevier
3,987,240 A 10/1976 Schultz
4,000,446 A 12/1976 Vandevier
4,021,700 A 5/1977 Ellis-Anwyl
4,030,450 A 6/1977 Hoult
4,041,470 A 8/1977 Slane et al.
4,061,442 A 12/1977 Clark et al.
4,087,204 A 5/1978 Niedermeyer
4,108,574 A 8/1978 Bartley et al.
4,123,792 A 10/1978 Gephart et al.
4,133,058 A 1/1979 Baker
4,142,415 A 3/1979 Jung et al.
4,151,080 A 4/1979 Zuckerman et al.
4,157,728 A 6/1979 Mitamura et al.
4,168,413 A 9/1979 Halpine
4,169,377 A 10/1979 Scheib
4,182,363 A 1/1980 Fuller et al.
4,185,187 A 1/1980 Rogers
4,187,503 A 2/1980 Walton
4,206,634 A 6/1980 Taylor
4,215,975 A 8/1980 Niedermeyer
4,222,711 A 9/1980 Mayer
4,225,290 A 9/1980 Allington
4,228,427 A 10/1980 Niedermeyer
4,233,553 A 11/1980 Prince
4,241,299 A 12/1980 Bertone
4,255,747 A 3/1981 Bunia
4,263,535 A 4/1981 Jones
4,276,454 A 6/1981 Zathan
4,286,303 A 8/1981 Genheimer et al.
4,303,203 A 12/1981 Avery
4,307,327 A 12/1981 Streater et al.
4,309,157 A 1/1982 Niedermeyer
4,314,478 A 2/1982 Beaman
4,319,712 A 3/1982 Bar
4,322,297 A 3/1982 Bajka
4,330,412 A 5/1982 Frederick
4,332,527 A 6/1982 Moldovan et al.
4,353,220 A 10/1982 Curwein
4,366,426 A 12/1982 Turlej
4,369,438 A 1/1983 Wilhelmi
4,370,098 A 1/1983 McClain et al.
4,370,690 A 1/1983 Baker
4,371,315 A 2/1983 Shikasho
4,375,613 A 3/1983 Fuller et al.
4,384,825 A 5/1983 Thomas et al.
4,394,262 A 7/1983 Bukowski et al.
4,399,394 A 8/1983 Ballman
4,402,094 A 9/1983 Sanders
4,409,532 A 10/1983 Hollenbeck
4,419,625 A 12/1983 Bejot et al.
4,420,787 A 12/1983 Tibbits et al.
4,421,643 A 12/1983 Frederick
4,425,836 A 1/1984 Pickrell
4,427,545 A 1/1984 Arguilez
4,428,434 A 1/1984 Gelaude
4,429,343 A 1/1984 Freud
4,437,133 A 3/1984 Rueckert
4,448,072 A 5/1984 Tward
4,449,260 A 5/1984 Whitaker
4,453,118 A 6/1984 Phillips
4,456,432 A 6/1984 Mannino
4,462,758 A 7/1984 Speed
4,463,304 A 7/1984 Miller
4,468,604 A 8/1984 Zaderej
4,470,092 A 9/1984 Lombardi
4,473,338 A 9/1984 Garmong
4,494,180 A 1/1985 Streater
4,496,895 A 1/1985 Kawate et al.
4,504,773 A 3/1985 Suzuki et al.
4,505,643 A 3/1985 Millis et al.

(56) References Cited

U.S. PATENT DOCUMENTS

D278,529 S 4/1985 Hoogner
4,514,989 A 5/1985 Mount
4,520,303 A 5/1985 Ward
4,529,359 A 7/1985 Sloan
4,541,029 A 9/1985 Ohyama
4,545,906 A 10/1985 Frederick
4,552,512 A 11/1985 Gallup et al.
4,564,041 A 1/1986 Kramer
4,564,882 A 1/1986 Baxter
4,581,900 A 4/1986 Lowe
4,604,563 A 8/1986 Min
4,605,888 A 8/1986 Kim
4,610,605 A 9/1986 Hartley
4,620,835 A 11/1986 Bell
4,622,506 A 11/1986 Shemanske
4,635,441 A 1/1987 Ebbing et al.
4,647,825 A 3/1987 Profio et al.
4,651,077 A 3/1987 Woyski
4,652,802 A 3/1987 Johnston
4,658,195 A 4/1987 Min
4,658,203 A 4/1987 Freymuth
4,668,902 A 5/1987 Zeller, Jr.
4,670,697 A 6/1987 Wrege
4,676,914 A 6/1987 Mills et al.
4,678,404 A 7/1987 Lorett et al.
4,678,409 A 7/1987 Kurokawa
4,686,439 A 8/1987 Cunningham
4,695,779 A 9/1987 Yates
4,697,464 A 10/1987 Martin
4,703,387 A 10/1987 Mller
4,705,629 A 11/1987 Weir
4,716,605 A 1/1988 Shepherd
4,719,399 A 1/1988 Wrege
4,728,882 A 3/1988 Stanbro
4,751,449 A 6/1988 Chmiel
4,751,450 A 6/1988 Lorenz
4,758,697 A 7/1988 Jeuneu
4,761,601 A 8/1988 Zaderej
4,764,417 A 8/1988 Gulya
4,764,714 A 8/1988 Alley
4,766,329 A 8/1988 Santiago
4,767,280 A 8/1988 Markuson
4,780,050 A 10/1988 Caine et al.
4,781,525 A 11/1988 Hubbard
4,782,278 A 11/1988 Bossi
4,786,850 A 11/1988 Chmiel
4,789,307 A 12/1988 Sloan
4,795,314 A 1/1989 Prybella et al.
4,801,858 A 1/1989 Min
4,804,901 A 2/1989 Pertessis
4,806,457 A 2/1989 Yanagisawa
4,820,964 A 4/1989 Kadah
4,827,197 A 5/1989 Giebler
4,834,624 A 5/1989 Jensen
4,837,656 A 6/1989 Barnes
4,839,571 A 6/1989 Farnham
4,841,404 A 6/1989 Marshall et al.
4,843,295 A 6/1989 Thompson
4,862,053 A 8/1989 Jordan
4,864,287 A 9/1989 Kierstead
4,885,655 A 12/1989 Springer et al.
4,891,569 A 1/1990 Light
4,896,101 A 1/1990 Cobb
4,907,610 A 3/1990 Meincke
4,912,936 A 4/1990 Denpou
4,913,625 A 4/1990 Gerlowski
4,949,748 A 8/1990 Chatrathi
4,958,118 A 9/1990 Pottebaum
4,963,778 A 10/1990 Jensen
4,967,131 A 10/1990 Kim
4,971,522 A 11/1990 Butlin
4,975,798 A 12/1990 Edwards et al.
4,977,394 A 12/1990 Manson et al.
4,985,181 A 1/1991 Strada et al.
4,986,919 A 1/1991 Allington
4,996,646 A 2/1991 Farrington
D315,315 S 3/1991 Stairs, Jr.
4,998,097 A 3/1991 Noth et al.
5,015,151 A 5/1991 Snyder, Jr. et al.
5,015,152 A 5/1991 Greene
5,017,853 A 5/1991 Chmiel
5,026,256 A 6/1991 Kuwabara
5,028,854 A 7/1991 Moline
5,041,771 A 8/1991 Min
5,051,068 A 9/1991 Wong
5,051,681 A 9/1991 Schwarz
5,076,761 A 12/1991 Krohn
5,076,763 A 12/1991 Anastos et al.
5,079,784 A 1/1992 Rist et al.
5,091,817 A 2/1992 Alley
5,098,023 A 3/1992 Burke
5,099,181 A 3/1992 Canon
5,100,298 A 3/1992 Shibata
RE33,874 E 4/1992 Miller
5,103,154 A 4/1992 Dropps
5,117,233 A 5/1992 Hamos et al.
5,123,080 A 6/1992 Gillett
5,129,264 A 7/1992 Lorenc
5,135,359 A 8/1992 Dufresne
5,145,323 A 9/1992 Farr
5,151,017 A 9/1992 Sears et al.
5,154,821 A 10/1992 Reid
5,156,535 A 10/1992 Budris
5,158,436 A 10/1992 Jensen
5,159,713 A 10/1992 Gaskell
5,164,651 A 11/1992 Hu
5,166,595 A 11/1992 Leverich
5,167,041 A 12/1992 Burkitt
5,172,089 A 12/1992 Wright et al.
D334,542 S 4/1993 Lowe
5,206,573 A 4/1993 McCleer et al.
5,213,477 A 5/1993 Watanabe et al.
5,222,867 A 6/1993 Walker, Sr. et al.
5,234,286 A 8/1993 Wagner
5,234,319 A 8/1993 Wilder
5,235,235 A 8/1993 Martin
5,238,369 A 8/1993 Far
5,240,380 A 8/1993 Mabe
5,245,272 A 9/1993 Herbert
5,247,236 A 9/1993 Schroeder
5,255,148 A 10/1993 Yeh
5,272,933 A 12/1993 Collier
5,295,790 A 3/1994 Bossart et al.
5,295,857 A 3/1994 Toly
5,296,795 A 3/1994 Dropps
5,302,885 A 4/1994 Schwarz
5,319,298 A 6/1994 Wanzong et al.
5,324,170 A 6/1994 Anastos et al.
5,327,036 A 7/1994 Carey
5,342,176 A 8/1994 Redlich
5,347,664 A 9/1994 Hamza et al.
5,349,281 A 9/1994 Bugaj
5,351,709 A 10/1994 Vos
5,351,714 A 10/1994 Barnowski
5,352,969 A 10/1994 Gilmore et al.
5,360,320 A 11/1994 Jameson et al.
5,361,215 A 11/1994 Tompkins
5,363,912 A 11/1994 Wolcott
5,394,748 A 3/1995 McCarthy
5,418,984 A 5/1995 Livingston, Jr.
D359,458 S 6/1995 Pierret
5,422,014 A 6/1995 Allen et al.
5,423,214 A 6/1995 Lee
5,425,624 A 6/1995 Williams
5,443,368 A 8/1995 Weeks et al.
5,444,354 A 8/1995 Takahashi
5,449,274 A 9/1995 Kochan, Jr.
5,449,997 A 9/1995 Gilmore et al.
5,450,316 A 9/1995 Gaudet et al.
D363,060 S 10/1995 Hunger
5,457,373 A 10/1995 Heppe et al.
5,457,826 A 10/1995 Haraga et al.
5,466,995 A 11/1995 Genga
5,469,215 A 11/1995 Nashiki

(56) References Cited

U.S. PATENT DOCUMENTS 5,471,125 A 11/1995 Wu
5,473,497 A 12/1995 Beatty
5,483,229 A 1/1996 Tamura et al.
5,495,161 A 2/1996 Hunter
5,499,902 A 3/1996 Rockwood
5,511,397 A 4/1996 Makino et al.
5,512,809 A 4/1996 Banks et al.
5,512,883 A 4/1996 Lane
5,518,371 A 5/1996 Wellstein
5,519,848 A 5/1996 Wloka
5,520,517 A 5/1996 Sipin
5,522,707 A 6/1996 Potter
5,528,120 A 6/1996 Brodetsky
5,529,462 A 6/1996 Hawes
5,532,635 A 7/1996 Watrous
5,540,555 A 7/1996 Corso et al.
D372,719 S 8/1996 Jensen
5,545,012 A 8/1996 Anastos et al.
5,548,854 A 8/1996 Bloemer et al.
5,549,456 A 8/1996 Burrill
5,550,497 A 8/1996 Carobolante
5,550,753 A 8/1996 Tompkins et al.
5,559,418 A 9/1996 Burkhart
5,559,720 A 9/1996 Tompkins
5,559,762 A 9/1996 Sakamoto
5,561,357 A 10/1996 Schroeder
5,562,422 A 10/1996 Ganzon et al.
5,563,759 A 10/1996 Nadd
D375,908 S 11/1996 Schumaker
5,570,481 A 11/1996 Mathis et al.
5,571,000 A 11/1996 Zimmerman
5,577,890 A 11/1996 Nielson et al.
5,580,221 A 12/1996 Triezenberg
5,582,017 A 12/1996 Noji et al.
5,587,899 A 12/1996 Ho et al.
5,589,076 A 12/1996 Womack
5,589,753 A 12/1996 Kadah
5,592,062 A 1/1997 Bach
5,598,080 A 1/1997 Jensen
5,601,413 A 2/1997 Langley
5,604,491 A 2/1997 Coonley et al.
5,614,812 A 3/1997 Wagoner
5,616,239 A 4/1997 Wendell et al.
5,618,460 A 4/1997 Fowler
5,622,223 A 4/1997 Vasquez
5,624,237 A 4/1997 Prescott et al.
5,626,464 A 5/1997 Schoenmeyr
5,628,896 A 5/1997 Klingenberger
5,629,601 A 5/1997 Feldstein
5,632,468 A 5/1997 Schoenmeyr
5,633,540 A 5/1997 Moan
5,640,078 A 6/1997 Kou et al.
5,654,504 A 8/1997 Smith et al.
5,654,620 A 8/1997 Langhorst
5,669,323 A 9/1997 Pritchard
5,672,050 A 9/1997 Webber et al.
5,682,624 A 11/1997 Ciochetti
5,690,476 A 11/1997 Miller
5,708,337 A 1/1998 Breit et al.
5,708,348 A 1/1998 Frey et al.
5,711,483 A 1/1998 Hays
5,712,795 A 1/1998 Layman et al.
5,713,320 A 2/1998 Pfaff et al.
5,727,933 A 3/1998 Laskaris et al.
5,730,861 A 3/1998 Sterghos
5,731,673 A 3/1998 Gilmore
5,736,884 A 4/1998 Ettes et al.
5,739,648 A 4/1998 Ellis et al.
5,744,921 A 4/1998 Makaran
5,752,785 A 5/1998 Tanaka et al.
5,754,036 A 5/1998 Walker
5,754,421 A 5/1998 Nystrom
5,763,969 A 6/1998 Metheny et al.
5,767,606 A 6/1998 Bresolin
5,777,833 A 7/1998 Romillon
5,780,992 A 7/1998 Beard
5,791,882 A 8/1998 Stucker
5,796,234 A 8/1998 Vrionis
5,802,910 A 9/1998 Krahn et al.
5,804,080 A 9/1998 Klingenberger
5,808,441 A 9/1998 Nehring
5,814,966 A 9/1998 Williamson
5,818,708 A 10/1998 Wong
5,818,714 A 10/1998 Zou
5,819,848 A 10/1998 Ramusson
5,820,350 A 10/1998 Mantey et al.
5,828,200 A 10/1998 Ligman et al.
5,833,437 A 11/1998 Kurth et al.
5,836,271 A 11/1998 Saski
5,845,225 A 12/1998 Mosher
5,856,783 A 1/1999 Gibb
5,863,185 A 1/1999 Cochimin et al.
5,883,489 A 3/1999 Konrad
5,884,205 A 3/1999 Elmore et al.
5,892,349 A 4/1999 Bogwicz
5,894,609 A 4/1999 Barnett
5,898,958 A 5/1999 Hall
5,906,479 A 5/1999 Hawes
5,907,281 A 5/1999 Miller, Jr. et al.
5,909,352 A 6/1999 Klabunde et al.
5,909,372 A 6/1999 Thybo
5,914,881 A 6/1999 Trachier
5,920,264 A 7/1999 Kim et al.
5,930,092 A 7/1999 Nystrom
5,941,690 A 8/1999 Lin
5,944,444 A 8/1999 Motz et al.
5,945,802 A 8/1999 Konrad
5,946,469 A 8/1999 Chidester
5,947,689 A 9/1999 Schick
5,947,700 A 9/1999 McKain et al.
5,959,431 A 9/1999 Xiang
5,959,534 A 9/1999 Campbell
5,961,291 A 10/1999 Sakagami et al.
5,963,706 A 10/1999 Baik
5,969,958 A 10/1999 Nielsen
5,973,465 A 10/1999 Rayner
5,973,473 A 10/1999 Anderson
5,977,732 A 11/1999 Matsumoto
5,983,146 A 11/1999 Sarbach
5,986,433 A 11/1999 Peele et al.
5,987,105 A 11/1999 Jenkins et al.
5,991,939 A 11/1999 Mulvey
6,030,180 A 2/2000 Clarey et al.
6,037,742 A 3/2000 Rasmussen
6,043,461 A 3/2000 Holling et al.
6,045,331 A 4/2000 Gehm et al.
6,045,333 A 4/2000 Breit
6,046,492 A 4/2000 Machida
6,048,183 A 4/2000 Meza
6,056,008 A 5/2000 Adams et al.
6,059,536 A 5/2000 Stingl
6,065,946 A 5/2000 Lathrop
6,072,291 A 6/2000 Pedersen
6,080,973 A 6/2000 Thweatt, Jr.
6,081,751 A 6/2000 Luo
6,091,604 A 7/2000 Plougsgaard
6,092,992 A 7/2000 Imblum
6,094,026 A 7/2000 Cameron
D429,699 S 8/2000 Davis
D429,700 S 8/2000 Liebig
6,094,764 A 8/2000 Veloskey et al.
6,098,654 A 8/2000 Cohen et al.
6,102,665 A 8/2000 Centers et al.
6,110,322 A 8/2000 Teoh et al.
6,116,040 A 9/2000 Stark
6,119,707 A 9/2000 Jordan
6,121,746 A 9/2000 Fisher
6,121,749 A 9/2000 Wills et al.
6,125,481 A 10/2000 Sicilano
6,125,883 A 10/2000 Creps et al.
6,142,741 A 11/2000 Nishihata
6,146,108 A 11/2000 Mullendore
6,150,776 A 11/2000 Potter et al.
6,157,304 A 12/2000 Bennett et al.

(56) References Cited

U.S. PATENT DOCUMENTS 6,164,132 A 12/2000 Matulek
6,171,073 B1 1/2001 McKain et al.
6,178,393 B1 1/2001 Irvin
6,184,650 B1 2/2001 Gelbman
6,188,200 B1 2/2001 Maiorano
6,198,257 B1 3/2001 Belehradek et al.
6,199,224 B1 3/2001 Versland
6,203,282 B1 3/2001 Morin
6,208,112 B1 3/2001 Jensen et al.
6,212,956 B1 4/2001 Donald
6,213,724 B1 4/2001 Haugen
6,216,814 B1 4/2001 Fujita et al.
6,222,355 B1 4/2001 Ohshima
6,227,808 B1 5/2001 McDonough
6,232,742 B1 5/2001 Wacknov
6,236,177 B1 5/2001 Zick
6,238,188 B1 5/2001 McDonough
6,247,429 B1 6/2001 Hara
6,249,435 B1 6/2001 Lifson
6,251,285 B1 6/2001 Clochetti
6,253,227 B1 6/2001 Vicente et al.
D445,405 S 7/2001 Schneider
6,254,353 B1 7/2001 Polo
6,257,304 B1 7/2001 Jacobs et al.
6,257,833 B1 7/2001 Bates
6,259,617 B1 7/2001 Wu
6,264,431 B1 7/2001 Trizenberg
6,264,432 B1 7/2001 Kilayko et al.
6,280,611 B1 8/2001 Henkin et al.
6,282,370 B1 8/2001 Cline et al.
6,298,721 B1 10/2001 Schuppe et al.
6,299,414 B1 10/2001 Schoenmeyr
6,299,699 B1 10/2001 Porat et al.
6,318,093 B2 11/2001 Gaudet et al.
6,320,348 B1 11/2001 Kadah
6,326,752 B1 12/2001 Jensen et al.
6,329,784 B1 12/2001 Puppin
6,330,525 B1 12/2001 Hays
6,342,841 B1 1/2002 Stingl
6,349,268 B1 2/2002 Ketonen et al.
6,350,105 B1 2/2002 Kobayashi et al.
6,351,359 B1 2/2002 Jager
6,354,805 B1 3/2002 Moeller
6,355,177 B2 3/2002 Senner et al.
6,356,464 B1 3/2002 Balakrishnan
6,356,853 B1 3/2002 Sullivan
6,362,591 B1 3/2002 Moberg
6,364,620 B1 4/2002 Fletcher et al.
6,364,621 B1 4/2002 Yamauchi
6,366,053 B1 4/2002 Belehradek
6,366,481 B1 4/2002 Balakrishnan
6,369,463 B1 4/2002 Maiorano
6,373,204 B1 4/2002 Peterson
6,373,728 B1 4/2002 Aarestrup
6,374,854 B1 4/2002 Acosta
6,375,430 B1 4/2002 Eckert et al.
6,380,707 B1 4/2002 Rosholm
6,388,642 B1 5/2002 Cotis
6,390,781 B1 5/2002 McDonough
6,406,265 B1 6/2002 Hahn
6,407,469 B1 6/2002 Cline et al.
6,411,481 B1 6/2002 Seubert
6,415,808 B2 7/2002 Joshi
6,416,295 B1 7/2002 Nagai
6,426,633 B1 7/2002 Thybo
6,443,715 B1 9/2002 Mayleben et al.
6,445,565 B1 9/2002 Toyoda et al.
6,447,446 B1 9/2002 Smith et al.
6,448,713 B1 9/2002 Farkas et al.
6,450,771 B1 9/2002 Centers
6,462,971 B1 10/2002 Balakrishnan et al.
6,464,464 B2 10/2002 Sabini
6,468,042 B2 10/2002 Moller
6,468,052 B2 * 10/2002 McKain ..... A61H 33/6073
417/18
6,474,949 B1 11/2002 Arai
6,475,180 B2 11/2002 Peterson et al.
6,481,973 B1 11/2002 Struthers
6,483,278 B2 11/2002 Harvest
6,483,378 B2 11/2002 Blodgett
6,490,920 B1 12/2002 Netzer
6,493,227 B2 12/2002 Nielson et al.
6,496,392 B2 12/2002 Odel
6,499,961 B1 12/2002 Wyatt
6,501,629 B1 12/2002 Mariott
6,503,063 B1 1/2003 Brunsell
6,504,338 B1 1/2003 Eichorn
6,520,010 B1 2/2003 Bergveld
6,522,034 B1 2/2003 Nakayama
6,523,091 B2 2/2003 Tirumala
6,527,518 B2 3/2003 Ostrowski
6,534,940 B2 3/2003 Bell et al.
6,534,947 B2 3/2003 Johnson
6,537,032 B1 3/2003 Horiuchi
6,538,908 B2 3/2003 Balakrishnan et al.
6,539,797 B2 4/2003 Livingston
6,543,940 B2 4/2003 Chu
6,548,976 B2 4/2003 Jensen
6,564,627 B1 5/2003 Sabini
6,570,778 B2 5/2003 Lipo et al.
6,571,807 B2 6/2003 Jones
6,590,188 B2 7/2003 Cline
6,591,697 B2 7/2003 Henyan
6,591,863 B2 7/2003 Ruschell
6,595,051 B1 7/2003 Chandler, Jr.
6,595,762 B2 7/2003 Khanwilkar et al.
6,604,909 B2 8/2003 Schoenmeyr
6,607,360 B2 8/2003 Fong
6,616,413 B2 9/2003 Humpheries
6,623,245 B2 9/2003 Meza et al.
6,625,824 B1 9/2003 Lutz et al.
6,626,840 B2 9/2003 Drzewiecki
6,628,501 B2 9/2003 Toyoda
6,632,072 B2 10/2003 Lipscomb et al.
6,636,135 B1 10/2003 Vetter
6,638,023 B2 10/2003 Scott
D482,664 S 11/2003 Hunt
6,643,153 B2 11/2003 Balakrishnan
6,651,900 B1 11/2003 Yoshida
6,655,922 B1 12/2003 Flek
6,663,349 B1 12/2003 Discenzo et al.
6,665,200 B2 12/2003 Goto
6,672,147 B1 1/2004 Mazet
6,675,912 B2 1/2004 Carrier
6,676,382 B2 1/2004 Leighton et al.
6,676,831 B2 1/2004 Wolfe
6,687,141 B2 2/2004 Odell
6,687,923 B2 2/2004 Dick
6,690,250 B2 2/2004 Moller
6,696,676 B1 2/2004 Graves et al.
6,700,333 B1 3/2004 Hirshi et al.
6,709,240 B1 3/2004 Schmalz
6,709,241 B2 3/2004 Sabini
6,709,575 B1 3/2004 Verdegan
6,715,996 B2 4/2004 Moeller
6,717,318 B1 4/2004 Mathiasssen
6,732,387 B1 5/2004 Waldron
6,737,905 B1 5/2004 Noda
D490,726 S 6/2004 Eungprabhanth
6,742,387 B2 6/2004 Hamamoto
6,747,367 B2 6/2004 Cline et al.
6,758,655 B2 7/2004 Sacher
6,761,067 B1 7/2004 Capano
6,768,279 B1 7/2004 Skinner
6,770,043 B1 8/2004 Kahn
6,774,664 B2 8/2004 Godbersen
6,776,038 B1 8/2004 Horton et al.
6,776,584 B2 8/2004 Sabini et al.
6,778,868 B2 8/2004 Imamura et al.
6,779,205 B2 8/2004 Mulvey
6,782,309 B2 8/2004 Laflamme
6,783,328 B2 8/2004 Lucke
6,799,950 B2 8/2004 Meier et al.
6,789,024 B1 9/2004 Kochan, Jr. et al.

(56) References Cited

U.S. PATENT DOCUMENTS

| | | | |
|---|---|---|---|
| 6,794,921 | B2 | 9/2004 | Abe |
| 6,797,164 | B2 | 9/2004 | Leaverton |
| 6,798,271 | B2 | 9/2004 | Swize |
| 6,806,677 | B2 | 10/2004 | Kelly et al. |
| 6,837,688 | B2 | 1/2005 | Kimberlin et al. |
| 6,842,117 | B2 | 1/2005 | Keown |
| 6,847,130 | B1 | 1/2005 | Belehradek et al. |
| 6,847,854 | B2 | 1/2005 | Discenzo |
| 6,854,479 | B2 | 2/2005 | Harwood |
| 6,863,502 | B2 | 3/2005 | Bishop et al. |
| 6,867,383 | B1 | 3/2005 | Currier |
| 6,875,961 | B1 | 4/2005 | Collins |
| 6,882,165 | B2 | 4/2005 | Ogura |
| 6,884,022 | B2 | 4/2005 | Albright |
| D504,900 | S | 5/2005 | Wang |
| D505,429 | S | 5/2005 | Wang |
| 6,888,537 | B2 | 5/2005 | Albright |
| 6,895,608 | B2 | 5/2005 | Goettl |
| 6,900,736 | B2 | 5/2005 | Crumb |
| 6,906,482 | B2 | 6/2005 | Shimizu |
| D507,243 | S | 7/2005 | Miller |
| 6,914,793 | B2 | 7/2005 | Balakrishnan |
| 6,922,348 | B2 | 7/2005 | Nakajima |
| 6,925,823 | B2 | 8/2005 | Lifson |
| 6,933,693 | B2 | 8/2005 | Schuermann |
| 6,941,785 | B2 | 9/2005 | Haynes et al. |
| 6,943,325 | B2 | 9/2005 | Pittman |
| 6,973,794 | B2 | 9/2005 | Street |
| D511,530 | S | 11/2005 | Wang |
| D512,026 | S | 11/2005 | Nurmi |
| 6,965,815 | B1 | 11/2005 | Tompkins et al. |
| 6,966,967 | B2 | 11/2005 | Curry |
| D512,440 | S | 12/2005 | Wang |
| 6,973,974 | B2 | 12/2005 | McLoughlin et al. |
| 6,976,052 | B2 | 12/2005 | Tompkins et al. |
| D513,737 | S | 1/2006 | Riley |
| 6,981,399 | B1 | 1/2006 | Nybo et al. |
| 6,981,402 | B2 | 1/2006 | Bristol |
| 6,984,158 | B2 | 1/2006 | Satoh |
| 6,989,649 | B2 | 1/2006 | Melhorn |
| 6,993,414 | B2 | 1/2006 | Shah |
| 6,998,807 | B2 | 2/2006 | Phillips |
| 6,998,977 | B2 | 2/2006 | Gregori et al. |
| 7,005,818 | B2 | 2/2006 | Jensen |
| 7,012,394 | B2 | 3/2006 | Moore et al. |
| 7,015,599 | B2 | 3/2006 | Gull et al. |
| 7,040,107 | B2 | 5/2006 | Lee et al. |
| 7,042,192 | B2 | 5/2006 | Mehlhorn |
| 7,050,278 | B2 | 5/2006 | Poulsen |
| 7,055,189 | B2 | 6/2006 | Goettl |
| 7,070,134 | B1 | 7/2006 | Hoyer |
| 7,077,781 | B2 | 7/2006 | Ishikawa |
| 7,080,508 | B2 | 7/2006 | Stavale |
| 7,081,728 | B2 | 7/2006 | Kemp |
| 7,083,392 | B2 | 8/2006 | Meza |
| 7,083,438 | B2 | 8/2006 | Massaro et al. |
| 7,089,607 | B2 | 8/2006 | Barnes et al. |
| 7,100,632 | B2 | 9/2006 | Harwood |
| 7,102,505 | B2 | 9/2006 | Kates |
| 7,107,184 | B2 | 9/2006 | Gentile et al. |
| 7,112,037 | B2 | 9/2006 | Sabini et al. |
| 7,114,926 | B2 | 10/2006 | Oshita |
| 7,117,120 | B2 | 10/2006 | Beck et al. |
| 7,141,210 | B2 | 11/2006 | Bell |
| 7,142,932 | B2 | 11/2006 | Spria et al. |
| D533,512 | S | 12/2006 | Nakashima |
| 7,163,380 | B2 | 1/2007 | Jones |
| 7,172,366 | B1 | 2/2007 | Bishop, Jr. |
| 7,174,273 | B2 | 2/2007 | Goldberg |
| 7,178,179 | B2 | 2/2007 | Barnes |
| 7,183,741 | B2 | 2/2007 | Mehlhorn |
| 7,195,462 | B2 | 3/2007 | Nybo et al. |
| 7,201,563 | B2 | 4/2007 | Studebaker |
| 7,221,121 | B2 | 5/2007 | Skaug |
| 7,244,106 | B2 | 7/2007 | Kallaman |
| 7,245,105 | B2 | 7/2007 | Joo |
| 7,259,533 | B2 | 8/2007 | Yang et al. |
| 7,264,449 | B1 | 9/2007 | Harned et al. |
| 7,281,958 | B2 | 10/2007 | Schuttler et al. |
| 7,292,898 | B2 | 11/2007 | Clark et al. |
| 7,307,538 | B2 | 12/2007 | Kochan, Jr. |
| 7,309,216 | B1 | 12/2007 | Spadola et al. |
| 7,318,344 | B2 | 1/2008 | Heger |
| D562,349 | S | 2/2008 | Bulter |
| 7,327,275 | B2 | 2/2008 | Brochu |
| 7,339,126 | B1 | 3/2008 | Niedermeyer |
| D567,189 | S | 4/2008 | Stiles, Jr. |
| 7,352,550 | B2 | 4/2008 | Mladenik |
| 7,375,940 | B1 | 5/2008 | Bertrand |
| 7,388,348 | B2 | 6/2008 | Mattichak |
| 7,407,371 | B2 | 8/2008 | Leone |
| 7,427,844 | B2 | 9/2008 | Mehlhorn |
| 7,429,842 | B2 | 9/2008 | Schulman et al. |
| 7,437,215 | B2 | 10/2008 | Anderson et al. |
| D582,797 | S | 12/2008 | Fraser |
| D583,828 | S | 12/2008 | Li |
| 7,458,782 | B1 | 12/2008 | Spadola et al. |
| 7,459,886 | B1 | 12/2008 | Potanin et al. |
| 7,484,938 | B2 | 2/2009 | Allen |
| 7,516,106 | B2 | 4/2009 | Ehlers |
| 7,517,351 | B2 | 4/2009 | Culp et al. |
| 7,525,280 | B2 | 4/2009 | Fagan et al. |
| 7,528,579 | B2 | 5/2009 | Pacholok et al. |
| 7,542,251 | B2 | 6/2009 | Ivankovic |
| 7,542,252 | B2 | 6/2009 | Chan et al. |
| 7,572,108 | B2 | 8/2009 | Koehl |
| 7,612,510 | B2 | 11/2009 | Koehl |
| 7,612,529 | B2 | 11/2009 | Kochan, Jr. |
| 7,623,986 | B2 | 11/2009 | Miller |
| 7,641,449 | B2 | 1/2010 | Iimura et al. |
| 7,652,441 | B2 | 1/2010 | Ho |
| 7,686,587 | B2 | 3/2010 | Koehl |
| 7,686,589 | B2 | 3/2010 | Stiles et al. |
| 7,690,897 | B2 | 4/2010 | Branecky |
| 7,700,887 | B2 | 4/2010 | Niedermeyer |
| 7,704,051 | B2 | 4/2010 | Koehl |
| 7,707,125 | B2 | 4/2010 | Haji-Valizadeh |
| 7,727,181 | B2 | 6/2010 | Rush |
| 7,739,733 | B2 | 6/2010 | Szydlo |
| 7,746,063 | B2 | 6/2010 | Sabini et al. |
| 7,751,159 | B2 | 7/2010 | Koehl |
| 7,753,880 | B2 | 7/2010 | Malackowski |
| 7,755,318 | B1 | 7/2010 | Panosh |
| 7,775,327 | B2 | 8/2010 | Abraham |
| 7,777,435 | B2 | 8/2010 | Aguilar |
| 7,788,877 | B2 | 9/2010 | Andras |
| 7,795,824 | B2 | 9/2010 | Shen et al. |
| 7,808,211 | B2 | 10/2010 | Pacholok et al. |
| 7,815,420 | B2 | 10/2010 | Koehl |
| 7,821,215 | B2 | 10/2010 | Koehl |
| 7,845,913 | B2 | 12/2010 | Stiles et al. |
| 7,854,597 | B2 | 12/2010 | Stiles et al. |
| 7,857,600 | B2 | 12/2010 | Koehl |
| 7,874,808 | B2 | 1/2011 | Stiles |
| 7,878,766 | B2 | 2/2011 | Meza |
| 7,900,308 | B2 | 3/2011 | Erlich |
| 7,925,385 | B2 | 4/2011 | Stavale et al. |
| 7,931,447 | B2 | 4/2011 | Levin et al. |
| 7,945,411 | B2 | 5/2011 | Keman et al. |
| 7,976,284 | B2 | 7/2011 | Koehl |
| 7,983,877 | B2 | 7/2011 | Koehl |
| 7,990,091 | B2 | 8/2011 | Koehl |
| 8,007,255 | B2 | 8/2011 | Hattori et al. |
| 8,011,895 | B2 | 9/2011 | Ruffo |
| 8,019,479 | B2 | 9/2011 | Stiles |
| 8,032,256 | B1 | 10/2011 | Wolf et al. |
| 8,043,070 | B2 | 10/2011 | Stiles |
| 8,049,464 | B2 | 11/2011 | Muntermann |
| 8,098,048 | B2 | 1/2012 | Hoff |
| 8,104,110 | B2 | 1/2012 | Caudill et al. |
| 8,126,574 | B2 | 2/2012 | Discenzo et al. |
| 8,133,034 | B2 | 3/2012 | Mehlhorn et al. |
| 8,134,336 | B2 | 3/2012 | Michalske et al. |
| 8,164,470 | B2 | 4/2012 | Brochu et al. |

(56) References Cited

U.S. PATENT DOCUMENTS 8,177,520 B2 5/2012 Mehlhorn
8,281,425 B2 10/2012 Cohen
8,299,662 B2 10/2012 Schmidt et al.
8,303,260 B2 11/2012 Stavale et al.
8,313,306 B2 * 11/2012 Stiles, Jr. ..... F04B 49/10 417/26
8,316,152 B2 11/2012 Geltner et al.
8,317,485 B2 11/2012 Meza et al.
8,337,166 B2 12/2012 Meza et al.
8,380,355 B2 2/2013 Mayleben et al.
8,405,346 B2 3/2013 Trigiani
8,405,361 B2 3/2013 Richards et al.
8,444,394 B2 5/2013 Koehl
8,465,262 B2 6/2013 Stiles et al.
8,469,675 B2 6/2013 Stiles et al.
8,480,373 B2 7/2013 Stiles et al.
8,500,413 B2 8/2013 Stiles et al.
8,540,493 B2 9/2013 Koehl
8,547,065 B2 10/2013 Trigiani
8,573,952 B2 11/2013 Stiles et al.
8,579,600 B2 11/2013 Vijayakumar et al.
8,602,743 B2 * 12/2013 Stiles, Jr. ..... F04B 49/10 417/26
8,602,745 B2 12/2013 Stiles
8,641,383 B2 2/2014 Meza
8,641,385 B2 2/2014 Koehl
8,669,494 B2 3/2014 Tran
8,756,991 B2 6/2014 Edwards
8,763,315 B2 7/2014 Hartman
8,774,972 B2 7/2014 Rusnak
8,801,389 B2 8/2014 Stiles, Jr. et al.
8,981,684 B2 3/2015 Drye et al.
9,030,066 B2 5/2015 Drye
9,051,930 B2 6/2015 Stiles, Jr. et al.
9,238,918 B2 1/2016 McKinzie
9,726,184 B2 * 8/2017 Stiles, Jr. ..... F04B 49/10
9,822,782 B2 11/2017 McKinzie
2001/0002238 A1 5/2001 McKain
2001/0029407 A1 10/2001 Tompkins
2001/0041139 A1 11/2001 Sabini et al.
2002/0000789 A1 1/2002 Haba
2002/0002989 A1 1/2002 Jones
2002/0010839 A1 1/2002 Tirumala et al.
2002/0018721 A1 2/2002 Kobayashi
2002/0032491 A1 3/2002 Imamura et al.
2002/0035403 A1 3/2002 Clark et al.
2002/0050490 A1 5/2002 Pittman et al.
2002/0070611 A1 6/2002 Cline et al.
2002/0070875 A1 6/2002 Crumb
2002/0076330 A1 6/2002 Lipscomb et al.
2002/0082727 A1 6/2002 Laflamme et al.
2002/0089236 A1 7/2002 Cline et al.
2002/0093306 A1 7/2002 Johnson
2002/0101193 A1 8/2002 Farkas
2002/0111554 A1 8/2002 Drzewiecki
2002/0131866 A1 9/2002 Phillips
2002/0136642 A1 * 9/2002 Moller ..... F04B 49/065 417/44.11
2002/0143478 A1 10/2002 Vanderah et al.
2002/0150476 A1 10/2002 Lucke
2002/0163821 A1 11/2002 Odell
2002/0172055 A1 11/2002 Balakrishnan
2002/0176783 A1 11/2002 Moeller
2002/0190687 A1 12/2002 Bell et al.
2003/0000303 A1 1/2003 Livingston
2003/0017055 A1 1/2003 Fong
2003/0030954 A1 2/2003 Bax et al.
2003/0034284 A1 2/2003 Wolfe
2003/0034761 A1 2/2003 Goto
2003/0048646 A1 3/2003 Odell
2003/0049134 A1 3/2003 Leighton et al.
2003/0063900 A1 4/2003 Wang et al.
2003/0099548 A1 5/2003 Meza
2003/0106147 A1 6/2003 Cohen et al.
2003/0061004 A1 7/2003 Discenzo
2003/0138327 A1 7/2003 Jones et al.
2003/0174450 A1 9/2003 Nakajima et al.
2003/0186453 A1 10/2003 Bell
2003/0196942 A1 10/2003 Jones
2004/0000525 A1 1/2004 Hornsby
2004/0006486 A1 1/2004 Schmidt et al.
2004/0009075 A1 1/2004 Meza
2004/0013531 A1 1/2004 Curry et al.
2004/0016241 A1 1/2004 Street et al.
2004/0025244 A1 2/2004 Lloyd et al.
2004/0055363 A1 3/2004 Bristol
2004/0062658 A1 4/2004 Beck et al.
2004/0064292 A1 4/2004 Beck
2004/0071001 A1 4/2004 Balakrishnan
2004/0080325 A1 4/2004 Ogura
2004/0080352 A1 4/2004 Noda
2004/0090197 A1 5/2004 Schuchmann
2004/0095183 A1 5/2004 Swize
2004/0116241 A1 6/2004 Ishikawa
2004/0117330 A1 6/2004 Ehlers et al.
2004/0118203 A1 6/2004 Heger
2004/0149666 A1 8/2004 Ehlers et al.
2004/0205886 A1 10/2004 Goettel
2004/0213676 A1 10/2004 Phillips
2004/0261167 A1 12/2004 Panopoulos
2004/0265134 A1 12/2004 Iimura et al.
2005/0050908 A1 3/2005 Lee et al.
2005/0058548 A1 3/2005 Thomas et al.
2005/0086957 A1 4/2005 Lifson
2005/0092946 A1 5/2005 Fellington et al.
2005/0095150 A1 5/2005 Leone et al.
2005/0097665 A1 5/2005 Goettel
2005/0123408 A1 * 6/2005 Koehl ..... F04D 15/0088 417/53
2005/0133088 A1 6/2005 Bologeorges
2005/0137720 A1 6/2005 Spira et al.
2005/0156568 A1 7/2005 Yueh
2005/0158177 A1 7/2005 Mehlhorn
2005/0162787 A1 7/2005 Weigel
2005/0167345 A1 8/2005 De Wet et al.
2005/0168900 A1 8/2005 Brochu et al.
2005/0170936 A1 8/2005 Quinn
2005/0180868 A1 8/2005 Miller
2005/0190094 A1 9/2005 Andersen
2005/0193485 A1 9/2005 Wolfe
2005/0195545 A1 9/2005 Mladenik
2005/0226731 A1 10/2005 Mehlhorn
2005/0235732 A1 10/2005 Rush
2005/0248310 A1 11/2005 Fagan et al.
2005/0260079 A1 11/2005 Allen
2005/0281679 A1 12/2005 Niedermeyer
2005/0281681 A1 12/2005 Anderson
2006/0045750 A1 3/2006 Stiles
2006/0045751 A1 3/2006 Beckman et al.
2006/0078435 A1 4/2006 Burza
2006/0078444 A1 4/2006 Sacher
2006/0090255 A1 * 5/2006 Cohen ..... E04H 4/12 4/509
2006/0093492 A1 5/2006 Janesky
2006/0106503 A1 5/2006 Lamb et al.
2006/0127227 A1 6/2006 Mehlhorn
2006/0138033 A1 6/2006 Hoal et al.
2006/0146462 A1 7/2006 McMillian et al.
2006/0162787 A1 7/2006 Yeh
2006/0169322 A1 8/2006 Torkelson
2006/0201555 A1 9/2006 Hamza
2006/0204367 A1 9/2006 Meza
2006/0226997 A1 10/2006 Kochan, Jr.
2006/0235573 A1 10/2006 Guion
2006/0269426 A1 11/2006 Llewellyn
2007/0001635 A1 1/2007 Ho
2007/0041845 A1 2/2007 Freudenberger
2007/0061051 A1 3/2007 Maddox
2007/0080660 A1 4/2007 Fagan et al.
2007/0113647 A1 5/2007 Mehlhorn
2007/0114162 A1 5/2007 Stiles et al.
2007/0124321 A1 5/2007 Szydlo
2007/0154319 A1 * 7/2007 Stiles, Jr. ..... F04B 49/20 417/42

(56) References Cited

U.S. PATENT DOCUMENTS

| | | | |
|---|---|---|---|
| 2007/0154320 | A1 | 7/2007 | Stiles |
| 2007/0154321 | A1 | 7/2007 | Stiles |
| 2007/0154322 | A1 | 7/2007 | Stiles |
| 2007/0154323 | A1 | 7/2007 | Stiles |
| 2007/0160480 | A1 | 7/2007 | Ruffo |
| 2007/0163929 | A1 | 7/2007 | Stiles |
| 2007/0177985 | A1 | 8/2007 | Walls et al. |
| 2007/0183902 | A1* | 8/2007 | Stiles, Jr. ..... F04B 49/20 417/42 |
| 2007/0187185 | A1 | 8/2007 | Abraham et al. |
| 2007/0188129 | A1 | 8/2007 | Kochan, Jr. |
| 2007/0212210 | A1 | 9/2007 | Kernan et al. |
| 2007/0212229 | A1 | 9/2007 | Stavale et al. |
| 2007/0212230 | A1 | 9/2007 | Stavale et al. |
| 2007/0219652 | A1 | 9/2007 | McMillan |
| 2007/0258827 | A1 | 11/2007 | Gierke |
| 2008/0003114 | A1 | 1/2008 | Levin et al. |
| 2008/0031751 | A1 | 2/2008 | Littwin et al. |
| 2008/0031752 | A1 | 2/2008 | Littwin et al. |
| 2008/0039977 | A1 | 2/2008 | Clark et al. |
| 2008/0041839 | A1 | 2/2008 | Tran |
| 2008/0044293 | A1 | 2/2008 | Hanke et al. |
| 2008/0063535 | A1 | 3/2008 | Koehl |
| 2008/0095638 | A1 | 4/2008 | Branecky |
| 2008/0095639 | A1 | 4/2008 | Bartos |
| 2008/0131286 | A1 | 6/2008 | Koehl |
| 2008/0131289 | A1 | 6/2008 | Koehl |
| 2008/0131291 | A1 | 6/2008 | Koehl |
| 2008/0131294 | A1 | 6/2008 | Koehl |
| 2008/0131295 | A1 | 6/2008 | Koehl |
| 2008/0131296 | A1 | 6/2008 | Koehl |
| 2008/0140353 | A1 | 6/2008 | Koehl |
| 2008/0152508 | A1 | 6/2008 | Meza |
| 2008/0168599 | A1 | 7/2008 | Caudill |
| 2008/0181785 | A1 | 7/2008 | Koehl |
| 2008/0181786 | A1 | 7/2008 | Meza |
| 2008/0181787 | A1 | 7/2008 | Koehl |
| 2008/0181788 | A1 | 7/2008 | Meza |
| 2008/0181789 | A1 | 7/2008 | Koehl |
| 2008/0181790 | A1 | 7/2008 | Meza |
| 2008/0189885 | A1 | 8/2008 | Erlich |
| 2008/0229819 | A1 | 9/2008 | Mayleben et al. |
| 2008/0260540 | A1 | 10/2008 | Koehl |
| 2008/0288115 | A1 | 11/2008 | Rusnak et al. |
| 2008/0298978 | A1 | 12/2008 | Schulman et al. |
| 2009/0014044 | A1 | 1/2009 | Hartman |
| 2009/0038696 | A1 | 2/2009 | Levin et al. |
| 2009/0052281 | A1 | 2/2009 | Nybo |
| 2009/0104044 | A1 | 4/2009 | Koehl |
| 2009/0143917 | A1 | 6/2009 | Uy et al. |
| 2009/0204237 | A1 | 8/2009 | Sustaeta et al. |
| 2009/0204267 | A1 | 8/2009 | Sustaeta et al. |
| 2009/0208345 | A1 | 8/2009 | Moore et al. |
| 2009/0210081 | A1 | 8/2009 | Sustaeta et al. |
| 2009/0269217 | A1 | 10/2009 | Vijayakumar |
| 2009/0290991 | A1 | 11/2009 | Mehlhorn et al. |
| 2010/0079096 | A1 | 4/2010 | Braun et al. |
| 2010/0154534 | A1 | 6/2010 | Hampton |
| 2010/0166570 | A1 | 7/2010 | Hampton |
| 2010/0197364 | A1 | 8/2010 | Lee |
| 2010/0303654 | A1 | 12/2010 | Petersen et al. |
| 2010/0306001 | A1 | 12/2010 | Discenzo |
| 2010/0312398 | A1 | 12/2010 | Kidd et al. |
| 2011/0036164 | A1 | 2/2011 | Burdi |
| 2011/0044823 | A1 | 2/2011 | Stiles |
| 2011/0052416 | A1 | 3/2011 | Stiles |
| 2011/0061415 | A1 | 3/2011 | Ward |
| 2011/0066256 | A1 | 3/2011 | Sesay et al. |
| 2011/0077875 | A1 | 3/2011 | Tran |
| 2011/0084650 | A1 | 4/2011 | Kaiser et al. |
| 2011/0110794 | A1 | 5/2011 | Mayleben et al. |
| 2011/0280744 | A1 | 11/2011 | Ortiz et al. |
| 2011/0311370 | A1 | 12/2011 | Sloss et al. |
| 2012/0013285 | A1 | 1/2012 | Kasunich et al. |
| 2012/0020810 | A1 | 1/2012 | Stiles, Jr. et al. |
| 2012/0100010 | A1 | 4/2012 | Stiles et al. |
| 2013/0106217 | A1 | 5/2013 | Drye |
| 2013/0106321 | A1 | 5/2013 | Drye et al. |
| 2013/0106322 | A1 | 5/2013 | Drye |
| 2014/0018961 | A1 | 1/2014 | Guzelgunler |
| 2014/0372164 | A1 | 12/2014 | Egan et al. |

FOREIGN PATENT DOCUMENTS

| | | | |
|---|---|---|---|
| AU | 2007332716 | A1 | 6/2008 |
| AU | 2007332769 | A1 | 6/2008 |
| CA | 2548437 | A1 | 6/2005 |
| CA | 2731482 | A1 | 6/2005 |
| CA | 2517040 | A1 | 2/2006 |
| CA | 2528580 | A1 | 5/2007 |
| CA | 2672410 | A1 | 6/2008 |
| CA | 2672459 | A1 | 6/2008 |
| CN | 1821574 | A | 8/2006 |
| CN | 101165352 | | 4/2008 |
| DE | 3023463 | A1 | 2/1981 |
| DE | 2946049 | A1 | 5/1981 |
| DE | 29612980 | U1 | 10/1996 |
| DE | 19736079 | A1 | 8/1997 |
| DE | 19645129 | A1 | 5/1998 |
| DE | 29724347 | U1 | 11/2000 |
| DE | 10231773 | A1 | 2/2004 |
| DE | 19938490 | B4 | 4/2005 |
| EP | 0150068 | A2 | 7/1985 |
| EP | 0226858 | A1 | 7/1987 |
| EP | 0246769 | A2 | 11/1987 |
| EP | 0306814 | A1 | 3/1989 |
| EP | 0314249 | A1 | 3/1989 |
| EP | 0709575 | A1 | 6/1996 |
| EP | 0735273 | A1 | 10/1996 |
| EP | 0833436 | A2 | 4/1998 |
| EP | 0831188 | A3 | 2/1999 |
| EP | 0978657 | A1 | 2/2000 |
| EP | 1112680 | A2 | 4/2001 |
| EP | 1134421 | A1 | 9/2001 |
| EP | 0916026 | | 5/2002 |
| EP | 1315929 | | 6/2003 |
| EP | 1429034 | A2 | 6/2004 |
| EP | 1585205 | A2 | 10/2005 |
| EP | 1630422 | A2 | 3/2006 |
| EP | 1698815 | A1 | 9/2006 |
| EP | 1790858 | A1 | 5/2007 |
| EP | 1995462 | A2 | 11/2008 |
| EP | 2102503 | A2 | 9/2009 |
| EP | 2122171 | A1 | 11/2009 |
| EP | 2122172 | A1 | 11/2009 |
| EP | 2273125 | A1 | 1/2011 |
| FR | 2529965 | A1 | 1/1984 |
| FR | 2703409 | A1 | 10/1994 |
| GB | 2124304 | A1 | 2/1984 |
| JP | 55072678 | A | 5/1980 |
| JP | 5010270 | A | 1/1993 |
| MX | 2009006258 | A1 | 12/2009 |
| WO | 98/04835 | A1 | 2/1998 |
| WO | 00/42339 | A1 | 7/2000 |
| WO | 01/27508 | A1 | 4/2001 |
| WO | 01/47099 | A1 | 6/2001 |
| WO | 02/018826 | A1 | 3/2002 |
| WO | 03/025442 | A1 | 3/2003 |
| WO | 03/099705 | A2 | 12/2003 |
| WO | 2004/006416 | A1 | 1/2004 |
| WO | 2004/073772 | A1 | 9/2004 |
| WO | 2004/088694 | A1 | 10/2004 |
| WO | 05/011473 | A1 | 2/2005 |
| WO | 2005011473 | A3 | 2/2005 |
| WO | 2005/055694 | A1 | 6/2005 |
| WO | 2005111473 | A2 | 11/2005 |
| WO | 2006/069568 | A1 | 7/2006 |
| WO | 2008/073329 | A1 | 6/2008 |
| WO | 2008/073330 | A1 | 6/2008 |
| WO | 2008073386 | A1 | 6/2008 |
| WO | 2008073413 | A1 | 6/2008 |
| WO | 2008073418 | A1 | 6/2008 |
| WO | 2008073433 | A1 | 6/2008 |
| WO | 2008073436 | A1 | 6/2008 |

(56) References Cited

FOREIGN PATENT DOCUMENTS

| | | | |
|---|---|---|---|
| WO | 2011/100067 | A1 | 8/2011 |
| WO | 2014152926 | A1 | 9/2014 |
| ZA | 200506869 | | 5/2006 |
| ZA | 200509691 | | 11/2006 |
| ZA | 200904747 | | 7/2010 |
| ZA | 200904849 | | 7/2010 |
| ZA | 200904850 | | 7/2010 |

OTHER PUBLICATIONS

51—Response by Defendants in Opposition to Motion for Preliminary Injunction for Civil Action 5:11-cv-00459D; Dec. 2, 2011.
Amended Complaint Filed by Pentair Water Pool & Spa, Inc. and Danfoss Drives A/S with respect to Civil Action No. 5:11-cv-00459, adding U.S. Pat. No. 8,043,070.
53—Declaration of Douglas C. Hopkins & Exhibits re Response Opposing Motion for Preliminary Injunction for Civil Action 5:11-cv-00459D; Dec. 2, 2011.
89—Reply to Response to Motion for Preliminary Injunction Filed by Danfoss Drives A/S & Pentair Water Pool & Spa, Inc. for Civil Action 5:11-cv-004590; Jan. 3, 2012.
105—Declaration re Memorandum in Opposition, Declaration of Lars Hoffmann Berthelsen for Civil Action 5:11-cv-00459D; Jan. 11, 2012.
112—Amended Complaint Against All Defendants, with Exhibits for Civil Action 5:11-cv-00459D; Jan. 17, 2012.
119—Order Denying Motion for Preliminary Injunction for Civil Action 5:11-cv-00459D; Jan. 23, 2012.
123—Answer to Amended Complaint, Counterclaim Against Danfoss Drives A/S, Pentair Water Pool & Spa, Inc. For Civil Action 5:11-cv-00459D; Jan. 27, 2012.
152—0rder Denying Motion for Reconsideration for Civil Action 5:11-cv-00459D; Apr. 4, 2012.
168—Amended Motion to Stay Action Pending Reexamination of Asserted Patents by Defendants for Civil Action 5:11-cv-004590; Jun. 13, 2012.
174—Notice and Attachments re Joint Claim Construction Statement for Civil Action 5:11-cv-00459D; Jun. 5, 2012.
186—Order Setting Hearings—Notice of Markman Hearing Set for Oct. 17, 2012 for Civil Action 5:11-cv-00459D; Jul. 12, 2012.
204—Response by Plaintiffs Opposing Amended Motion to Stay Action Pending Reexamination of Asserted Patents for Civil Action 5:11-cv-004590; Jul. 2012.
210—Order Granting Joint Motion for Leave to Enlarge Page Limit for Civil Action 5:11-cv-004590; Jul. 2012.
218—Notice re Plaintiffs re Order on Motion for Leave to File Excess Pages re Amended Joint Claim Construction Statement for Civil Action 5:11-cv-004590; Aug. 2012.
54DX16—Hayward EcoStar Technical Guide (Version2); 2011; pp. 1-51; cited in Civil Action 5:11-cv-004590.
54DX17—Hayward ProLogic Automation & Chlorination Operation Manual (Rev. F); pp. 1-27; Elizabeth, NJ; cited in Civil Action 5:11-cv-004590; Dec. 2, 2011.
54DX18—Stmicroelectronics; "AN1946—Sensorless BLOC Motor Control & BEMF Sampling Methods with ST7MC;" 2007; pp. 1-35; Civil Action 5:11-cv-004590.
54DX19—Stmicroelectronics; "AN1276 BLOC Motor Start Routine for ST72141 Microcontroller;" 2000; pp. 1-18; cited in Civil Action 5:11-cv-004590.
54DX21—DANFOSS; "VLT 8000 Aqua Instruction Manual;" Apr. 2004; 1-210; Cited in Civil Action 5:11-cv-004590.
54DX22—DANFOSS; "VLT 8000 Aqua Instruction Manual;" pp. 1-35; cited in Civil Action 5:11-cv-004590; Dec. 2, 2011.
54DX23—Commander; "Commander SE Advanced User Guide;" Nov. 2002; pp. 1-190; cited in Civil Action 5:11-cv-004590.
540X30—Sabbagh et al.; "A Model for OptimaL.Control of Pumping Stations in Irrigation Systems;" Jul. 1988; NL pp. 119-133; Civil Action 5:11-cv-004590.
540X31—0anfoss; "VLT 5000 FLUX Aqua OeviceNet Instruction Manual;" Apr. 28, 2003; pp. 1-39; cited in Civil Action 5:11-cv-004590.
540X32—0anfoss; "VLT 5000 FLUX Aqua Profibus Operating Instructions;" May 22, 2003; 1-64; cited in Civil Action 5:11-cv-004590.
540X33—Pentair; "IntelliTouch Owner's Manual Set-Up & Programming;" May 22, 2003; Sanford, NC; pp. 1-61; cited in Civil Action 5:11-cv-004590.
540X34—Pentair; "Compool3800 Pool-Spa Control System Installation & Operating Instructions;" Nov. 7, 1997; pp. 1-45; cited in Civil Action 5:11-cv-004590.
540X35—Pentair Advertisement in "Pool & Spa News;" Mar. 22, 2002; pp. 1-3; cited in Civil Action 5:11-cv-004590.
5540X36—Hayward; "Pro-Series High-Rate Sand Filter Owner's Guide;" 2002; Elizabeth, NJ; pp. 1-5; cited in Civil Action 5:11-cv-00459D.
540X37—Danfoss; "VLT 8000 Aqua Fact Sheet;" Jan. 2002; pp. 1-3; cited in Civil Action 5:11-cv-004590.
540X38—0anfoss; "VLT 6000 Series Installation, Operation & Maintenance Manual;" Mar. 2000; pp. 1-118; cited in civil Action 5:11-cv-004590.
540X45—Hopkins; "Synthesis of New Class of Converters that Utilize Energy Recirculation;" pp. 1-7; cited in Civil Action 5:11-cv-004590; 1994.
540X46—Hopkins; "High-Temperature, High-Oensity . . . Embedded Operation;" pp. 1-8; cited in Civil Action 5:11-cv-004590; Mar. 2006.
540X47—Hopkins; "Optimally Selecting Packaging Technologies . . . Cost & Performance;" pp. 1-9; cited in Civil Action 5:11-cv-004590; Jun. 1999.
9PX5—Pentair; Selected Website Pages; pp. 1-29; cited in Civil Action 5:11-cv-004590; Sep. 2011.
9PX6—Pentair; "IntelliFio Variable Speed Pump" Brochure; 2011; pp. 1-9; cited in Civil Action 5:11-cv-004590.
9PX7—Pentair; "IntelliFio VF Intelligent Variable Flow Pump;" 2011; pp. 1-9; cited in Civil Action 5:11-cv-004590.
9PX8—Pentair; "IntelliFio VS+SVRS Intelligent Variable Speed Pump;" 2011; pp. 1-9; cited in Civil Action 5:11-cv-004590.
9PX9—Sta-Rite; "IntelliPro Variable Speed Pump;" 2011; pp. 1-9; cited in Civil Action 5:11-cv-004590.
9PX14—Pentair; "IntelliFio Installation and User's Guide;" pp. 1-53; Jul. 26, 2011; Sanford, NC; cited in Civil Action 5:11-cv-004590.
9PX16—Hayward Pool Products; "EcoStar Owner's Manual (Rev. B);" pp. 1-32; Elizabeth, NJ; cited in civil Action 5:11-cv-00459D; 2010.
9PX17—Hayward Pool Products; "EcoStar & EcoStar SVRS Brochure;" pp. 1-7; Elizabeth, NJ; cited in Civil Action 5:11-cv-00459D; Sep. 30, 2011.
9PX19—Hayward Pool Products;"Hayward Energy Solutions Brochure;" pp. 1-3; www.haywardnet.com; cited in civil Action 5:11-cv-00459D; Sep. 2011.
9PX20—Hayward Pool Products; "ProLogic Installation Manual (Rev. G);" pp. 1-25; Elizabeth, NJ; cited in Civil Action 5:11-cv-00459D; Sep. 2011.
9PX21—Hayward Pool Products; "ProLogic Operation Manual (Rev. F);" pp. 1-27; Elizabeth, NJ; cited in Civil Action 5:11-cv-00459D; Sep. 2011.
9PX22—Hayward Pool Products; "Wireless & Wired Remote Controls Brochure;" pp. 1-5; 2010; Elizabeth, NJ; cited in Civil Action 5:11-cv-00459D.
9PX23—Hayward Pool Products; Selected Pages from Hayward's Website:/www.hayward-pool.com; pp. 1-27; cited in Civil Action 5:11-cv-004590; Sep. 2011.
9PX28—Hayward Pool Products; "Selected Page from Hayward's Website Relating to EcoStar Pumps;" p. 1; cited in Civil Action 5:11-cv-00459D; Sep. 2011.
9PX29—Hayward Pool Products; "Selected Page from Hayward's Website Relating to EcoStar SVRS Pumps;" cited in Civil Action 5:11-cv-00459; Sep. 2011.

(56) References Cited

OTHER PUBLICATIONS

9PX30—Hayward Pool Systems; "Selected Pages from Hayward's Website Relating to ProLogic Controllers;" pp. 1-5; Civil Action 5:11-cv-00459D; Sep. 2011.
9PX-42—Hayward Pool Systems; "Hayward EcoStar & EcoStar SVRS Variable Speed Pumps Brochure;" Civil Action 5:11-cv-00459D; 2010.
205-24-Exh23—Piaintiff's Preliminary Disclosure of Asserted Civil Claims and Preliminary Infringement Contentions; cited in Action 5:11-cv-00459; Feb. 21, 2012.
PX-34—Pentair; "IntelliTouch Pool & Spa Control System User's Guide"; pp. 1-129; 2011; cited in Civil Action 5:11-cv-00459; 2011.
PX-138—Deposition of Dr. Douglas C. Hopkins; pp. 1-391; 2011; taken in Civil Action 10-cv-1662.
PX-141—Danfoss; "Whitepaper Automatic Energy Optimization;" pp. 1-4; 2011; cited in Civil Action 5:11-cv-00459.
9PX10—Pentair; "IntelliPro VS+SVRS Intelligent Variable Speed Pump;" 2011; pp. 1-6; cited in Civil Action 5:11-cv-00459D.
9PX11—Pentair; "IntelliTouch Pool & Spa Control Control Systems;" 2011; pp. 1-5; cited in Civil Action 5:11-cv-004590.
Robert S. Carrow; "Electrician's Technical Reference-Variable Frequency Drives;" 2001; pp. 1-194.
Baldor; "Balder Motors and Drives Series 14 Vector Drive Control Operating & Technical Manual;" Mar. 22, 1992; pp. 1-92.
Commander; "Commander SE Advanced User Guide;" Nov. 2002; pp. 1-118.
Baldor; "Baldor Series 10 Inverter Control: Installation and Operating Manual"; Feb. 2000; pp. 1-74.
Dinverter; "Dinverter 28 User Guide;" Nov. 1998; pp. 1-94.
Pentair Pool Products, "IntelliFlo 4x160 a Breakthrough Energy-Efficiency and Service Life;" pp. 1-4; Nov. 2005; www.pentairpool.com.
Pentair Water and Spa, Inc. "The Pool Pro's guide to Breakthrough Efficiency, Convenience & Profitability," pp. 1-8, Mar. 2006; www.pentairpool.com.
Danfoss; "VLT8000 Aqua Instruction Manual;" Apr. 16, 2004; pp. 1-71.
"Product Focus—New AC Drive Series Target Water, Wastewater Applications;" WaterWorld Articles; Jul. 2002; pp. 1-2.
Pentair, "Pentair RS-485 Pool Controller Adapter" Published Advertisement; Mar. 22, 2002; pp. 1-2.
Compool; "Compool CP3800 Pool-Spa Control System Installation and Operating Instructions;" Nov. 7, 1997; pp. 1-45.
Hayward; "Hayward Pro-Series High-Rate Sand Filter Owner's Guide," 2002; pp. 1-4.
Danfoss; "Danfoss VLT 6000 Series Adjustable Frequency Drive Installation, Operation and Maintenance Manual;" Mar. 2000; pp. 1-118.
Brochure entitled "Constant Pressure Water for Private Well Systems," for Myers Pentair Pump Group, Jun. 28, 2000.
Brochure for AMTROL, Inc. entitled "AMTROL unearths the facts about variable speed pumps and constant pressure valves," Mar. 2002.
Undated Goulds Pumps "Balanced Flow Systems" Installation Record.
Texas Instruments, Digital Signal Processing Solution for AC Induction Motor, Application Note, BPRA043 (1996).
Texas Instruments, Zhenyu Yu and David Figoli, DSP Digital Control System Applications—AC Induction Motor Control Using Constant V/Hz Principle and Space Vector PWM Technique with TMS320C240, Application Report No. SPRA284A (Apr. 1998).
Texas Instruments, TMS320F/C240 DSP Controllers Reference Guide Peripheral Library and Specific Devices, Literature No. SPRU 161D (Nov. 2002).
Texas Instruments, MSP430x33x—Mixed Signal Microcontrollers, SLAS 163 (Feb. 1998).
Microchip Technology, Inc., PICMicro Mid-Range MCU Family Reference Manual (Dec. 1997).
7—Motion for Preliminary Injunction by Danfoss Drives A/S & Pentair Water Pool & Spa, Inc. with respect to Civil Action No. 5:11-cv-00459D, filed Sep. 30, 2011.
540X48—Hopkins; "Partitioning Oigitally . . . Applications to Ballasts;" pp. 1-6; cited in Civil Action 5:11-cv-00459D, Mar. 2002.
Load Controls Incorporated, product web pages including Affidavit of Christopher Butler of Internet Archive attesting to the authenticity of the web pages, dated Apr. 27, 2013, 19 pages.
Cliff Wyatt, "Monitoring Pumps," World Pumps, vol. 2004, Issue 459, Dec. 2004, pp. 17-21.
Wen Technology, Inc., Unipower® HPL110 Digital Power Monitor Installation and Operation, copyright 1999, pp. 1-20, Raleigh, North Carolina.
Wen Technology, Inc., Unipower® HPL110, HPL420 Programming Suggestions for Centrifugal Pumps, copyright 1999, 4 pages, Raleigh, North Carolina.
Danfoss, VLT® Aqua Drive, "The ultimate solution for Water, Wastewater, & Irrigation", May 2007, pp. 1-16.
Danfoss, SALT Drive Systems, "Increase oil & gas production, Minimize energy consumption", copyright 2011, pp. 1-16.
Schlumberger Limited, Oilfield Glossary, website Search Results for "pump-off", copyright 2014, 1 page.
45—Plaintiffs' Reply to Defendants' Answer to Complaint & Counterclaim for Civil Action 5:11-cv-00459D, filed Nov. 2, 2011.
50—Amended Answer to Complaint & Counterclaim by Defendants for Civil Action 5:11-cv-00459D, filed Nov. 23, 2011.
54DX32—Hopkins; "High-Temperature, High-Density . . . Embedded Operation;" pp. 1-8; cited in Civil Action 5:11-cv-00459D, Mar. 2006.
Pentair; "Pentair IntelliTouch Operating Manual;" May 22, 2003; pp. 1-60.
Bibliographic Data Sheet—U.S. Appl. No. 10/730,747 Applicant: Robert M. Koehl Reasons for Inclusion: Printed publication US 2005/0123408 A1 for U.S. Appl. No. 10/730,747 has incorrect filed.
Shabnam Moghanrabi; "Better, Stronger, Faster;" Pool & Spa News, Sep. 3, 2004; pp. 1-5; www/poolspanews.com.
Grundfos Pumps Corporation; "The New Standard in Submersible Pumps;" Brochure; pp. 1-8; Jun. 1999; Fresno, CA USA.
Grundfos Pumps Corporation; "Grundfos SQ/SQE Data Book;" pp. 1-39; Jun. 1999; Fresno, CA USA.
Goulds Pumps; "Balanced Flow System Brochure;" pp. 1-4; 2001.
Goulds Pumps; "Balanced Flow Submersible System Installation, Operation & Trouble-Shooting Manual;" pp. 1-9; 2000; USA.
Goulds Pumps; "Balanced Flow Submersible System Informational Seminar;" pp. 1-22; Undated.
Goulds Pumps; "Balanced Flow System Variable Speed Submersible Pump" Specification Sheet; pp. 1-2; Jan. 2000; USA
Goulds Pumps; Advertisement from "Pumps & Systems Magazine;" entitled "Cost Effective Pump Protection+ Energy Savings," Jan. 2002; Seneca Falls, NY.
Goulds Pumps; "Hydro-Pro Water System Tank Installation, Operation & Maintenance Instructions;" pp. 1-30; Mar. 31, 2001; Seneca Falls, NY USA.
Goulds Pumps; "Pumpsmart Control Solutions" Advertisement from Industrial Equipment News; Aug. 2002; New York, NY USA
Goulds Pumps; "Model BFSS List Price Sheet;" Feb. 5, 2001.
Goulds Pumps; "Balanced Flow System Model BFSS Variable Speed Submersible Pump System" Brochure; pp. 1-4; Jan 2001; USA.
Goulds Pumps; "Balanced Flow System Model BFSS Variable Speed Submersible Pump" Brochure; pp. 1-3; Jan. 2000; USA.
Goulds Pumps; "Balanced Flow System . . . The Future of Constant Pressure Has Arrived;" Undated Advertisement.
Amtrol Inc.; "AMTROL Unearths the Facts About Variable Speed Pumps and Constant Pressure Valves;" pp. 1-5; Mar. 2002; West Warwick, RI USA.
Franklin Electric; "CP Water-Subdrive 75 Constant Pressure Controller" Product Data Sheet; May 2001; Bluffton, IN USA.
Franklin-Electric "Franklin Aid, Subdrive 75: You Made It Better;" vol. 20, No. 1; pp. 1-2; Jan./Feb. 2002; www.franklin-electric.com.
Grundfos; "SQ/SQE—A New Standard in Submersible Pumps;" Undated Brochure; pp. 1-14; Denmark.

(56) References Cited

OTHER PUBLICATIONS

Grundfos; "JetPaq—The Complete Pumping System;" Undated Brochure; pp. 1-4; Clovis, CA USA.
Email Regarding Grundfos' Price Increases/SQ/SQE Curves; pp. 1-7; Dec. 19, 2001.
F.E. Myers; "Featured Product: F.E. Myers Introducts Revolutionary Constant Pressure Water System;" pp. 1-8; Jun. 28, 2000; Ashland, OH USA.
"Water Pressure Problems" Published Article; The American Well Owner; No. 2, Jul. 2000.
Bjarke Soerensen; "Have You Chatted With Your Pump Today?" Undated Article Reprinted with Permission of Grundfos Pump University; pp. 1-2; USA.
"Understanding Constant Pressure Control;" pp. 1-3; Nov. 1, 1999.
"Constant Pressure is the Name of the Game;" Published Article from National Driller; Mar. 2001.
Sje-Rhombus; "Variable Frequency Drives for Constant Pressure Control;" Aug. 2008; pp. 1-4; Detroit Lakes, MN USA.
Sje-Rhombus; "Constant Pressure Controller for Submersible Well Pumps;" Jan. 2009; pp. 1-4; Detroit Lakes, MN USA.
Sje-Rhombus; "SubCon Variable Frequency Drive;" Dec. 2008; pp. 1-2; Detroit Lakes, MN USA.
Grundfos; "SmartFio SQE Constant Pressure System;" Mar. 2002; pp. 1-4; Olathe, KS USA.
Grundfos; "Grundfos SmartFio SQE Constant Pressure System;" Mar. 2003; pp. 1-2; USA.
Grundfos; "Uncomplicated Electronics . . . Advanced Design;" pp. 1-10; Undated.
Grundfos; "CU301 Installation & Operation Manual;" Apr. 2009; pp. 1-2; Undated; www.grundfos.com.
Grundfos; "CU301 Installation & Operating Instructions;" Sep. 2005; pp. 1-30; Olathe, KS USA.
ITT Corporation; "Goulds Pumps Balanced Flow Submersible Pump Controller;" Jul. 2007; pp. 1-12.
ITT Corporation; "Goulds Pumps Balanced Flow;" Jul. 2006; pp. 1-8.
ITT Corporation; "Goulds Pumps Balanced Flow Constant Pressure Controller for 2 HP Submersible Pumps;" Jun. 2005; pp. 1-4 USA.
ITT Corporation; "Goulds Pumps Balanced Flow Constant Pressure Controller for 3 HP Submersible Pumps;" Jun. 2005; pp. 1-4; USA.
Franklin Electric; Constant Pressure in Just the Right Size; Aug. 2006; pp. 1-4; Bluffton, IN USA.
Franklin Electric; "Franklin Application Installation Data;" vol. 21, No. 5, Sep./Oct. 2003; pp. 1-2; www.franklin-electric.com.
Franklin Electric; "Monodrive MonodriveXT Single-Phase Constant Pressure;" Sep. 2008; pp. 1-2; Bluffton, IN USA.
Docket Report for Case No. 5:11-cv-00459-D; Nov. 2012.
1—Complaint Filed by Pentair Water Pool & Spa, Inc. and Danfoss Drives A/S with respect to Civil Action No. 5:11-cv-00459-D; Aug. 31, 2011.
7—Motion for Preliminary Injunction by Danfoss Drives AIS & Pentair Water Pool & Spa, Inc. with respect to Civil Action No. 5:11-cv-00459-D; Sep. 30, 2011.
22—Memorandum in Support of Motion for Preliminary Injunction by Plaintiffs with respect to Civil Action 5:11-cv-00459-D; Sep. 2, 2011.
23—Declaration of E. Randolph Collins, Jr. In Support of Motion for Preliminary Injunction with respect to Civil Action 5:11-cv-00459-D; Sep. 30, 2011.
24—Declaration of Zack Picard in Support of Motion for Preliminary Injunction with respect to Civil Action 5:11-cv-00459-D; Sep. 30, 2011.
32—Answer to Complaint with Jury Demand & Counterclaim Against Plaintiffs by Hayward Pool Products & Hayward Industries for Civil Action 5:11-cv-004590; Oct. 12, 2011.
USPTO Patent Trial and Appeal Board, Paper 47—Final Written Decision, Case IPR2013-00285, Patent 8,019,479 B2, dated Nov. 19, 2014, 39 pages.
Pentair Pool Products, WhisperFlo Pump Owner's Manual, Jun. 5, 2001, 10 pages.
USPTO Patent Board Decision—Examiner Reversed; Appeal No. 2015-007909 re: U.S. Pat. No. 7,686,58762; dated Apr. 1, 2016.
USPTO Patent Board Decision—Examiner Affirmed in Part; Appeal No. 2016-002780 re: U.S. Pat. No. 7,854,597B2; dated Aug. 30, 2016.
USPTO Patent Board Decision—Decision on Reconsideration, Denied; Appeal No. 2015-007909 re: U.S. Pat. No. 7,686,587B2; dated Aug. 30, 2016.
Board Decision for Appeal 2016-002726, Reexamination Control 95/002,005, U.S. Pat. No. 7,857,60062 dated Jul. 1, 2016.
Flotec Owner's Manual, dated 2004. 44 pages.
Glentronics Home Page, dated 2007. 2 pages.
Goulds Pumps SPBB Battery Back-Up Pump Brochure, dated 2008. 2 pages.
Goulds Pumps SPBB/SPBB2 Battery Backup Sump Pumps, dated 2007.
ITT Red Jacket Water Products Installation, Operation and Parts Manual, dated 2009. 8 pages.
Liberty Pumps PC-Series Brochure, dated 2010. 2 pages.
"Lift Station Level Control" by Joe Evans PhD, www.pumped101.com, dated Sep. 2007. 5 pages.
The Basement Watchdog A/C-D/C Battery Backup Sump Pump System Instruction Manual and Safety Warnings, dated 2010. 20 pages.
The Basement Watchdog Computer Controlled A/C-D/C Sump Pump System Instruction Manual, dated 2010. 17 pages.
Pentair Water Ace Pump Catalog, dated 2007, 44 pages.
ITT Red Jacket Water Products RJBB/RJBB2 Battery Backup Sump Pumps; May 2007, 2 pages.
Allen-Bradley; "1336 Plus II Adjustable Frequency AC Drive with Sensorless Vector User Manual;" Sep. 2005; pp. 1-212.
Board Decision for Appeal 2015-007909, Reexamination Control 95/002,008, U.S. Pat. No. 7,686,587B2 dated Apr. 1, 2016.
USPTO Patent Trial and Appeal Board, Paper 43—Final Written Decision, Case IPR2013-00287, U.S. Pat. No. 7,704,051 B2, dated Nov. 19, 2014, 28 pages.
Danfoss, VLT 8000 AQUA Operating Instructions, coded MG.80. A2.02 in the footer, 181 pages.
Per Brath—Danfoss Drives A/S, Towards Autonomous Control of HVAC Systems, thesis with translation of Introduction, Sep. 1999, 216 pages.
Karl Johan Åström and Björn Wittenmark—Lund Institute of Technology, Adaptive Control—Second Edition, book, Copyright 1995, 589 pages, Addison-Wesley Publishing Company, United States and Canada.
Bimal K. Bose—The University of Tennessee, Knoxville, Modern Power Electronics and AC Drives, book, Copyright 2002, 728 pages, Prentice-Hall, Inc., Upper Saddle River, New Jersey.
Waterworld, New AC Drive Series Targets Water, Wastewater Applications, magazine, Jul. 2002, 5 pages, vol. 18, Issue 7.
Texas Instruments, TMS320F/C240 DSP Controllers Peripheral Library and Specific Devices, Reference Guide, Nov. 2002, 485 pages, printed in U.S.A.
Microchip Technology Inc., PICmicro® Advanced Analog Microcontrollers for 12-Bit ADC on 8-Bit MCUs, Convert to Microchip, brochure, Dec. 2000, 6 pages, Chandler, Arizona.
W.K. Ho, S.K. Panda, K.W. Lim, F.S. Huang—Department of Electrical Engineering, National University of Singapore, Gain-scheduling control of the Switched Reluctance Motor, Control Engineering Practice 6, copyright 1998, pp. 181-189, Elsevier Science Ltd.
Jan Eric Thorsen—Danfoss, Technical Paper—Dynamic simulation of DH House Stations, presented by 7. Dresdner Femwärme-Kolloquium Sep. 2002, 10 pages, published in Euro Heat & Power Jun. 2003.
Texas Instruments, Electronic Copy of TMS320F/C240 DSP Controllers Reference Guide, Peripheral Library and Specific Devices, Jun. 1999, 474 pages.
Rajwardhan Patil, et al., A Multi-Disciplinary Mechatronics Course with Assessment—Integrating Theory and Application through Laboratory Activities, International Journal of Engineering Education, copyright 2012, pp. 1141-1149, vol. 28, No. 5, TEMPUS Publications, Great Britain.

(56) References Cited

OTHER PUBLICATIONS

James Shirley, et al., A mechatronics and material handling systems laboratory: experiments and case studies, International Journal of Electrical Engineering Education 48/1, pp. 92-103.
U.S. Court of Appeals for the Federal Circuit, Notice of Entry of Judgment, accompanied by Opinion, in Case No. 2017-1021, Document 57-1, filed and entered Feb. 7, 2018, pp. 1-16.
U.S. Court of Appeals for the Federal Circuit, Notice of Entry of Judgment, accompanied by Opinion, in Case No. 2017-1124, Document 54-1, filed and entered Feb. 26, 2018, pp. 1-10.
U.S. Appl. No. 12/869,570 Appeal Decision dated May 24, 2016.

* cited by examiner

SAFETY VACUUM RELEASE SYSTEM

RELATED APPLICATIONS

This application is a continuation of U.S. application Ser. No. 14/095,911 filed on Dec. 3, 2013, which is a continuation of U.S. application Ser. No. 13/350,167 filed on Jan. 13, 2012, which is a divisional of U.S. application Ser. No. 12/572,774 filed on Oct. 2, 2009, which claims priority under 35 U.S.C. § 119 to U.S. Provisional Patent Application No. 61/102,935 filed on Oct. 6, 2008, the entire contents of which are incorporated herein by reference.

BACKGROUND

Pool pumps are used to move water in one or more aquatic applications, such as pools, spas, and water features. The aquatic applications include one or more water inlets and one or more water outlets. The water outlets are connected to an inlet of the pool pump. The pool pump generally propels the water though a filter and back into the aquatic applications though the water inlets. For large pools, the pool pump must provide high flow rates in order to effectively filter the entire volume of pool water. These high flow rates can result in high velocities in the piping system connecting the water outlets and the pool pump. If a portion of the piping system is obstructed or blocked, this can result in a high suction force near the water outlets of the aquatic applications. As a result, foreign objects can be trapped against the water outlets, which are often covered by grates in the bottom or sides of the pool. Systems have been developed to try to quickly shut down the pool pump when a foreign object is obstructing the water outlets of the aquatic applications. However, these systems often result in nuisance tripping (i.e., the pool pump is shut down too often when there are no actual obstructions).

SUMMARY

Some embodiments of the invention provide a pumping system for at least one aquatic application. The pumping system includes a pump, a motor coupled to the pump, a user interface associated with the pump designed to receive input instructions from a user, and a controller in communication with the motor. The controller determines a power parameter associated with the motor and compares the power parameter to a predetermined threshold value. The controller triggers a safety vacuum release system based on the comparison of the power parameter and the threshold value.

Some embodiments of the invention provide a safety vacuum release system for at least one aquatic application. The safety vacuum release system includes a pump including an inlet, a motor coupled to the pump, and a controller in communication with the motor. The controller is designed to detect if an obstruction is present in the inlet based on at least one measurement related to the power consumption of the motor.

Other embodiments of the invention provide a safety vacuum release system for at least one aquatic application. The safety vacuum release system comprises a pump including an inlet, a motor coupled to the pump, a detached controller designed to operate the pump, and an on-board controller in communication with the motor. The on-board controller is designed to detect if an obstruction is present in the inlet based only on at least one measurement related to the power consumption of the motor defining a power consumption value.

DETAILED DESCRIPTION

Figure 1:
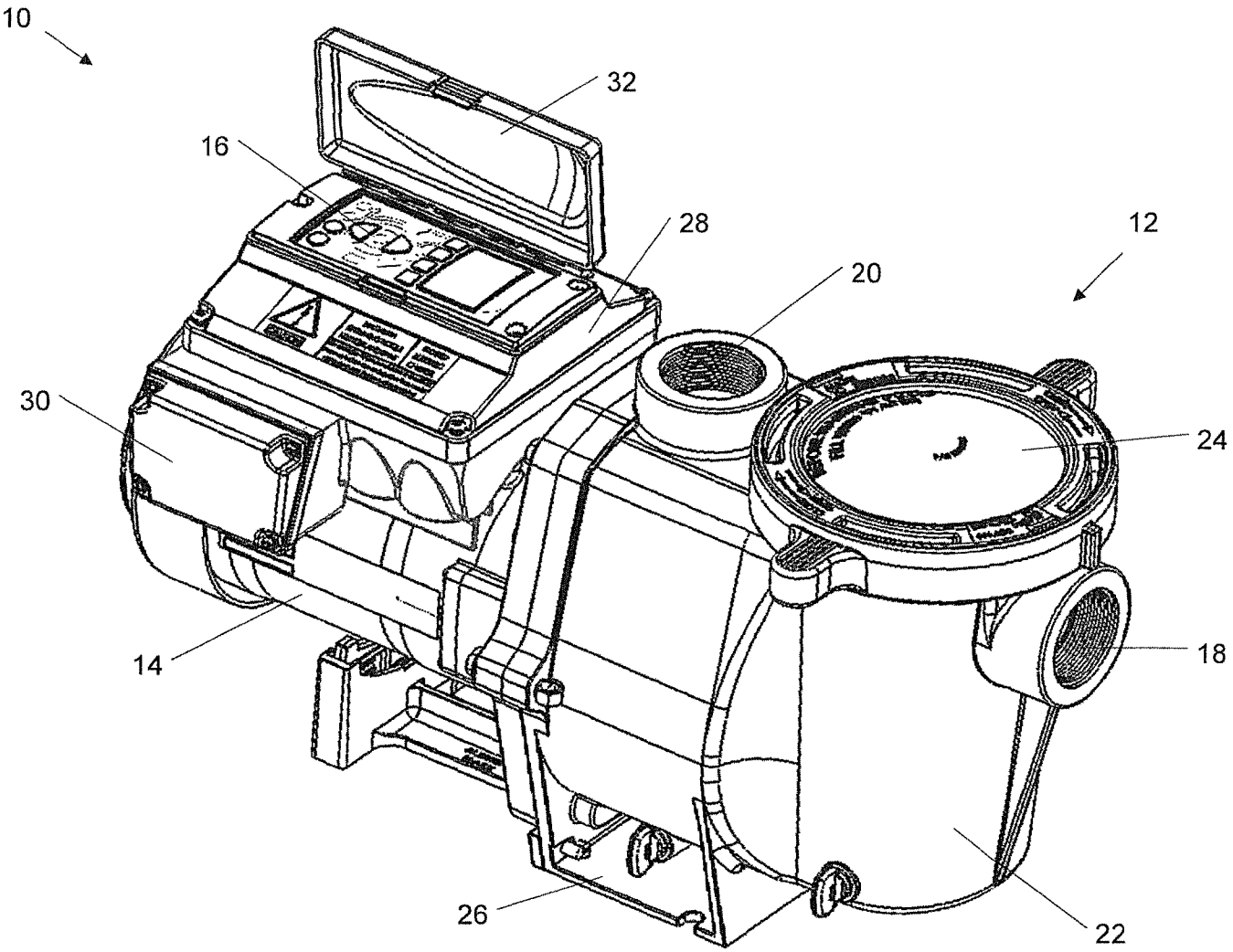
FIG. 1 is a perspective view of a pool pump according to one embodiment of the invention.

Before any embodiments of the invention are explained in detail, it is to be understood that the invention is not limited in its application to the details of construction and the arrangement of components set forth in the following description or illustrated in the following drawings. The invention is capable of other embodiments and of being practiced or of being carried out in various ways. Also, it is to be understood that the phraseology and terminology used herein is for the purpose of description and should not be regarded as limiting. The use of "including," "comprising," or "having" and variations thereof herein is meant to encompass the items listed thereafter and equivalents thereof as well as additional items. Unless specified or limited otherwise, the terms "mounted," "connected," "supported," and "coupled" and variations thereof are used broadly and encompass both direct and indirect mountings, connections, supports, and couplings. Further, "connected" and "coupled" are not restricted to physical or mechanical connections or couplings.

The following discussion is presented to enable a person skilled in the art to make and use embodiments of the invention. Various modifications to the illustrated embodiments will be readily apparent to those skilled in the art, and the generic principles herein can be applied to other embodiments and applications without departing from embodiments of the invention. Thus, embodiments of the invention are not intended to be limited to embodiments shown, but are to be accorded the widest scope consistent with the principles and features disclosed herein. The following detailed description is to be read with reference to the figures, in which like elements in different figures have like reference numerals. The figures, which are not necessarily to scale, depict selected embodiments and are not intended to limit the scope of embodiments of the invention. Skilled artisans will recognize the examples provided herein have many useful alternatives and fall within the scope of embodiments of the invention.

FIG. 1 illustrates a pool pump 10 according to one embodiment of the invention. The pool pump 10 can be used for any suitable aquatic application, such as pools, spas, and water features. The pool pump 10 can include a housing 12, a motor 14, and an on-board controller 16. In some embodiments, the motor 14 can be a variable speed motor. In one embodiment, the motor 14 can be driven at four or more different speeds. The housing 12 can include an inlet 18, an outlet 20, a basket 22, a lid 24, and a stand 26. The stand 26 can support the motor 14 and can be used to mount the pool pump 10 on a suitable surface (not shown).

In some embodiments, the on-board controller 16 can be enclosed in a case 28. The case 28 can include a field wiring compartment 30 and a cover 32. The cover 32 can be opened and closed to allow access to the on-board controller 16 and protect it from moisture, dust, and other environmental influences. The case 28 can be mounted on the motor 14. In some embodiments, the field wiring compartment 30 can include a power supply to provide power to the motor 14 and the on-board controller 16.

Figure 2:
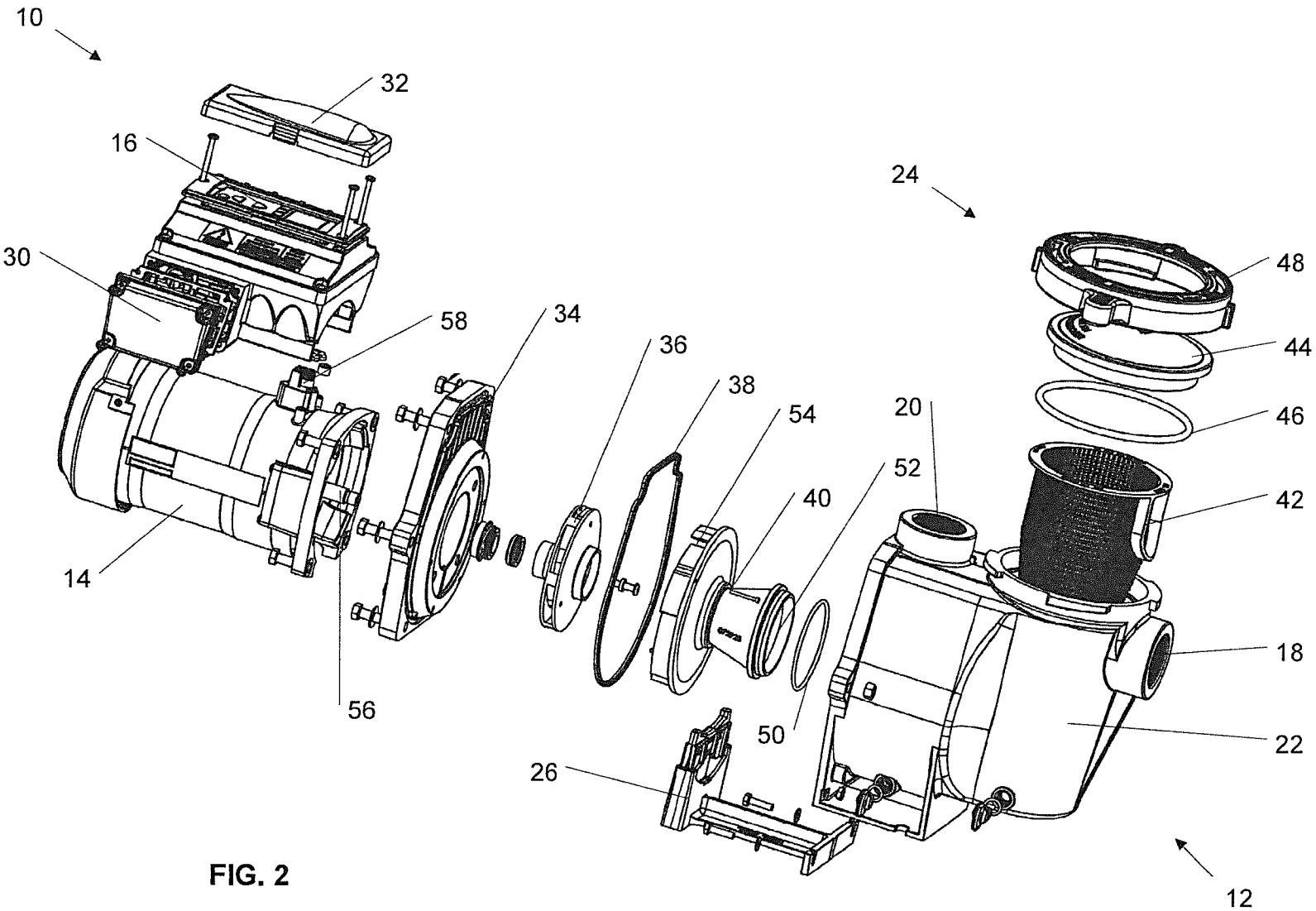
FIG. 2 is an exploded perspective view of the pool pump of FIG. 1.

FIG. 2 illustrates the internal components of the pool pump 10 according to one embodiment of the invention. The pool pump 10 can include seal plate 34, an impeller 36, a gasket 38, a diffuser 40, and a strainer 42. The strainer 42 can be inserted into the basket 22 and can be secured by the lid 24. In some embodiments, the lid 24 can include a cap 44, an O-ring 46, and a nut 48. The cap 44 and the O-ring 46 can be coupled to the basket 22 by screwing the nut 48 onto the basket 22. The O-ring 46 can seal the connection between the basket 22 and the lid 24. An inlet 52 of the diffuser 40 can be fluidly sealed to the basket 22 with a seal 50. In some embodiments, the diffuser 40 can enclose the impeller 36. An outlet 54 of the diffuser 40 can be fluidly sealed to the seal plate 34. The seal plate 34 can be sealed to the housing 12 with the gasket 38. The motor 14 can include a shaft 56, which can be coupled to the impeller 36. The motor 14 can rotate the impeller 36, drawing fluid from the inlet 18 through the strainer 42 and the diffuser 40 to the outlet 20.

In some embodiments, the motor 14 can include a coupling 58 to connect to the on-board controller 16. In some embodiments, the on-board controller 16 can automatically operate the pool pump 10 according to at least one schedule. If two or more schedules are programmed into the on-board controller 16, the schedule running the pool pump 10 at the highest speed can have priority over the remaining schedules. In some embodiments, the on-board controller 16 can allow a manual operation of the pool pump 10. If the pool pump 10 is manually operated and is overlapping a scheduled run, the scheduled run can have priority over the manual operation independent of the speed of the pool pump 10. In some embodiments, the on-board controller 16 can include a manual override. The manual override can interrupt the scheduled and/or manual operation of the pool pump 10 to allow for, e.g., cleaning and maintenance procedures. In some embodiments, the on-board controller 16 can monitor the operation of the pool pump 10 and can indicate abnormal conditions of the pool pump 10.

Figure 3B:
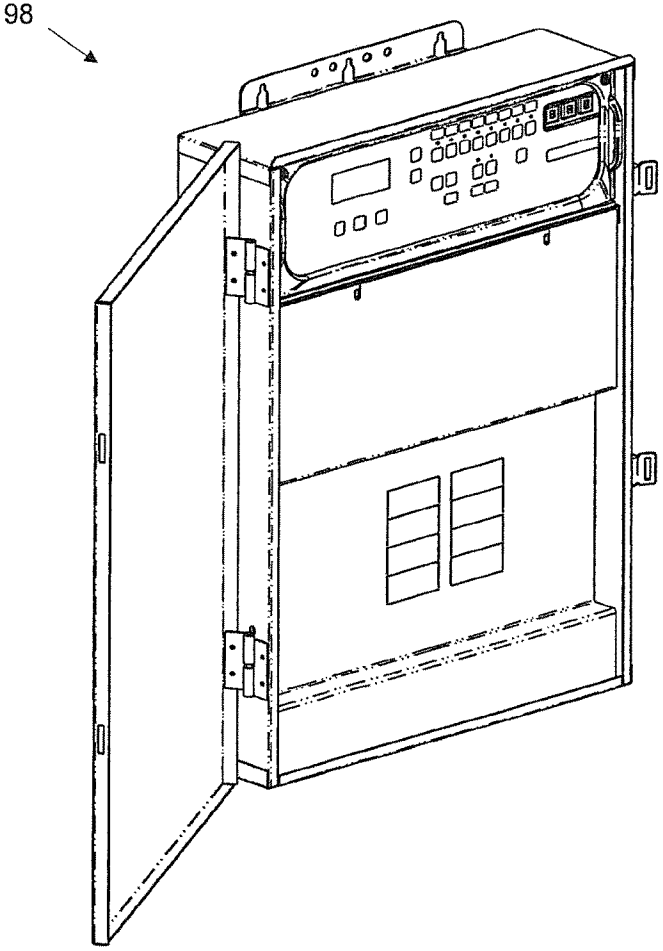
FIG. 3B is a perspective view of an external controller according to one embodiment, of the invention.
Figure 3A:
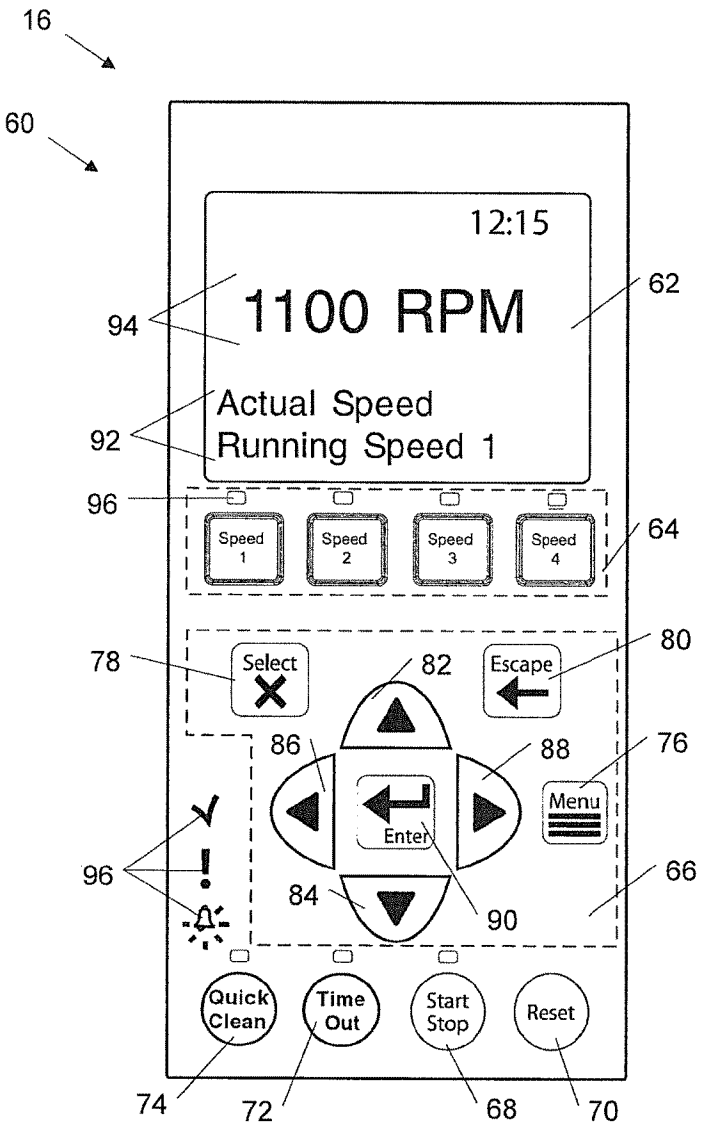
FIG. 3A is a front view of an on-board controller according to one embodiment of the invention.

FIG. 3A illustrates a user interface 60 for the on-board controller 16 according to one embodiment of the invention. The user interface 60 can include a display 62, at least one speed button 64, navigation buttons 66, a start-stop button 68, a reset button 70, a manual override button 72, and a "quick clean" button 74. The manual override button 72 can also be called "time out" button. In some embodiments, the navigation buttons 66 can include a menu button 76, a select button 78, an escape button 80, an up-arrow button 82, a down-arrow button 84, a left-arrow button 86, a right-arrow button 88, and an enter button 90. The navigation buttons 66 and the speed buttons 64 can be used to program a schedule into the on-board controller 16. In some embodiments, the display 62 can include a lower section 92 to display information about a parameter and an upper section 94 to display a value associated with that parameter. In some embodiments, the user interface 60 can include light emitting diodes (LEDs) 96 to indicate normal operation and/or a detected error of the pool pump 10.

The on-board controller 16 operates the motor 14 to provide a safety vacuum release system (SVRS) for the aquatic applications. If the on-board controller 16 detects an obstructed inlet 18, the on-board controller 16 can quickly shutdown the pool pump 10. In some embodiments, the on-board controller 16 can detect the obstructed inlet 18 based only on measurements and calculations related to the power consumption of the motor 14 (e.g., the power needed to rotate the motor shaft 56). In some embodiments, the on-board controller 16 can detect the obstructed inlet 18 without any additional inputs (e.g., without pressure, flow rate of the pumped fluid, speed or torque of the motor 14).

FIG. 3B illustrates an external controller 98 for the pool pump 10 according to one embodiment of the invention. The external controller 98 can communicate with the on-board controller 16. The external controller 98 can control the pool pump 10 in substantially the same way as the on-board controller 16. The external controller 98 can be used to operate the pool pump 10 and/or program the on-board controller 16, if the pool pump 10 is installed in a location where the user interface 60 is not conveniently accessible.

Figure 4:
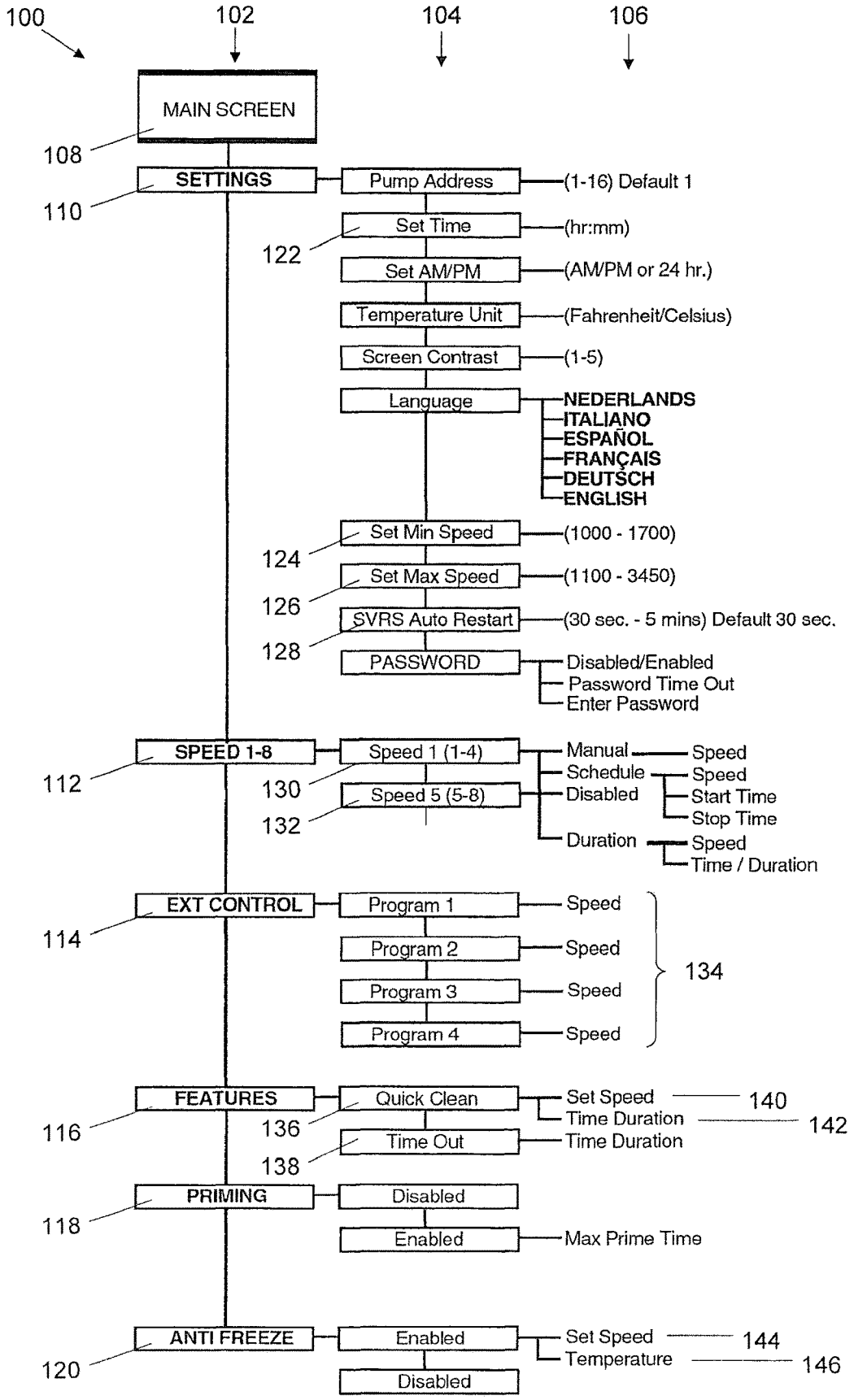
FIG. 4 is a flow chart of settings of the on-board controller of FIG. 3A and/or the external controller of FIG. 3B according to one embodiment of the invention.

FIG. 4 illustrates a menu 100 for the on-board controller 16 according to one embodiment of the invention. In some embodiments, the menu 100 can be used to program various features of the on-board controller 16. In some embodiments, the menu 100 can include a hierarchy of categories 102, parameters 104, and values 106. From a main screen 108, an operator can, in some embodiments, enter the menu 100 by pressing the menu button 76. The operator can scroll through the categories 102 using the up-arrow button 82 and the down-arrow button 84. In some embodiments, the categories 102 can include settings 110, speed 112, external control 114, features 116, priming 118, and anti freeze 120. In some embodiments, the operator can enter a category 102 by pressing the select button 78. The operator can scroll through the parameters 104 within a specific category 102 using the up-arrow button 82 and the down-arrow button 84. The operator can select a parameter 104 by pressing the select button 78 and can adjust the value 106 of the parameter 104 with the up-arrow button 82 and the down-arrow button 84. In some embodiments, the value 106 can be adjusted by a specific increment or the user can select from a list of options. The user can save the value 106 by pressing the enter button 90. By pressing the escape button 80, the user can exit the menu 100 without saving any changes.

In some embodiments, the settings category 110 can include a time setting 122, a minimum speed setting 124, a maximum speed setting 126, and a SVRS automatic restart setting 128. The time setting 122 can be used to run the pool pump 10 on a particular schedule. The minimum speed setting 124 and the maximum speed setting 126 can be adjusted according to the volume of the aquatic applications. An installer of the pool pump 10 can provide the minimum speed setting 124 and the maximum speed setting 126. The on-board controller 16 can automatically prevent the minimum speed setting 124 from being higher than the maximum speed setting 126. The pool pump 10 will not operate outside of these speeds in order to protect flow-dependent devices with minimum speeds and pressure-sensitive devices (e.g., filters) with maximum speeds. The SVRS automatic restart setting 128 can provide a time period before the on-board controller 16 will resume normal operation of the pool pump 10 after an obstructed inlet 18 has been detected and the pool pump 10 has been stopped. In some embodiments, there can be two minimum speed settings—one for dead head detection (higher speed) and one for dynamic detection (lower speed).

In some embodiments, the speed category 112 can be used to input data for running the pool pump 10 manually and/or automatically. In some embodiments, the on-board controller 16 can store a number of manual speeds 130 and a number of scheduled runs 132. In some embodiments, the manual speeds 130 can be programmed into the on-board controller 16 using the up-arrow button 82, the down-arrow button 84 and the enter button 90. Once programmed, the manual speeds 130 can be accessed by pressing one of the speed buttons 64 on the user interface 60. The scheduled runs 132 can be programmed into the on-board controller 16 using the up-arrow button 82, the down-arrow button 84, and the enter button 90. For the scheduled runs 132, a speed, a start time, and a stop time can be programmed. In some embodiments, the scheduled runs 132 can be programmed using a speed, a start time, and a duration. In some embodiments, the pool pump 10 can be programmed to run continuously.

The external control category 114 can include various programs 134. The programs 134 can be accessed by the external controller 98. The quantity of programs 134 can be equal to the number of scheduled runs 132.

The features category 116 can be used to program a manual override. In some embodiments, the parameters can include a "quick clean" program 136 and a "time out" program 138. The "quick clean" program 136 can include a speed setting 140 and a duration setting 142. The "quick clean" program 136 can be selected by pressing the "quick clean" button 74 located on the user interface 60. When pressed, the "quick clean" program 136 can have priority over the scheduled and/or manual operation of the pool pump 10. After the pool pump 10 has been operated for the time period of the duration setting 142, the pool pump 10 can resume to the scheduled and/or manual operation. If the SVRS has been previously triggered and the time period for the SVRS automatic restart 128 has not yet elapsed, the "quick clean" program 136 may not be initiated by the on-board controller 16. The "time out" program 138 can interrupt the operation of the pool pump 10 for a certain amount of time, which can be programmed into the on-board controller 16. The "time out" program 138 can be selected by pressing the "time out" button 72 on the user interface 60. The "time out" program 138 can be used to clean the aquatic application and/or to perform maintenance procedures.

In the priming category 118, the priming of the pool pump 10 can be enabled or disabled. If the priming is enabled, a duration for the priming sequence can be programmed into the on-board controller 16. In some embodiments, the priming sequence can be run at the maximum speed 126. The priming sequence can remove substantially all air in order to allow water to flow through the pool pump 10 and/or connected piping systems.

In some embodiments, a temperature sensor (not shown) can be connected to the on-board controller 16 in order to provide an anti-freeze operation for the pumping system and the pool pump 10. In the anti-freeze category 120, a speed setting 144 and a temperature setting 146 at which the pool pump 10 can be activated to prevent water from freezing in the pumping system can be programmed into the on-board controller 16. If the temperature sensor detects a temperature lower than the temperature setting 146, the pool pump 10 can be operated according to the speed setting 144. However, the anti-freeze operation can also be disabled.

Figure 5A:
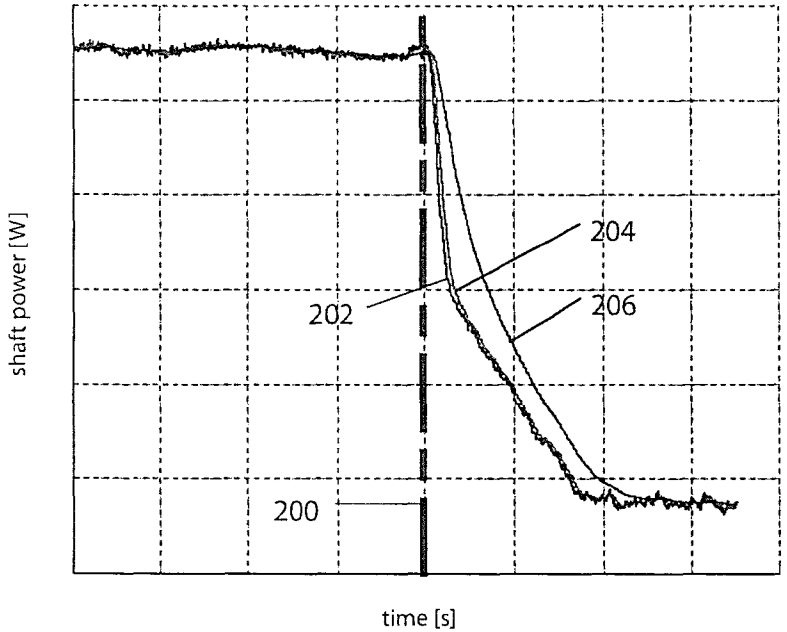
FIG. 5A is a graph of an absolute power variation of the pool pump when a clogged suction pipe occurs at a certain time.
Figure 5B:
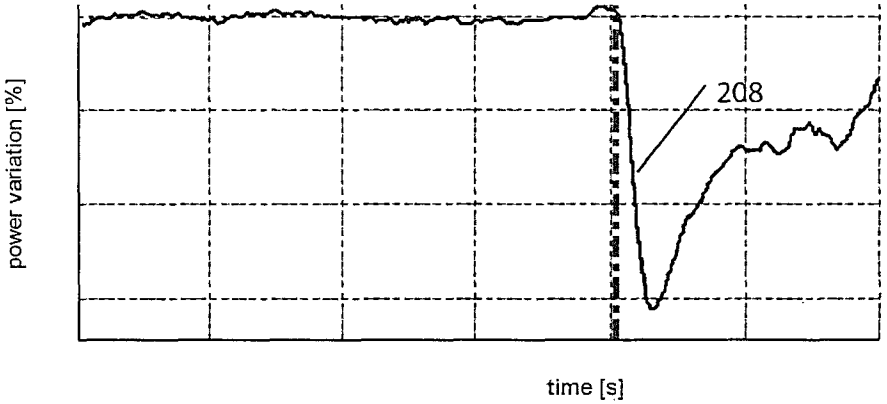
FIG. 5B is a graph of a relative power variation of the pool pump when a clogged suction pipe or water outlet occurs at a certain time.
Figure 5C:
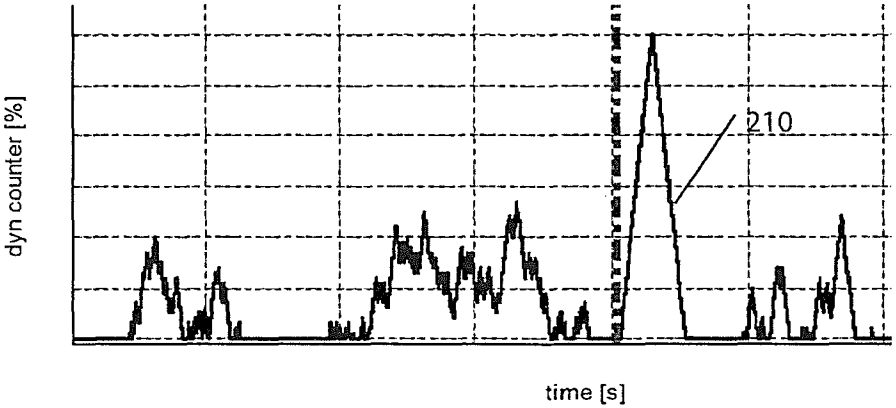
FIG. 5C is a graph of a relative counter for the relative power variation of FIG. 5B.

FIG. 5A-5C illustrate power consumption curves associated with the motor shaft 56 of the pool pump 10. The power consumption of the motor that is necessary to pump water and overcome losses will be referred to herein and in the appended claims as any one of "power consumption curves," "power consumption values," or simply "power consumption." FIG. 5A illustrates power consumption curves for the motor shaft 56 when the inlet 18 is obstructed at a particular time 200. FIG. 5A illustrates an actual power consumption curve 202, a current power consumption curve 204, and a lagged power consumption curve 206. The actual power consumption 202 can be evaluated by the on-board controller 16 during a certain time interval (e.g., about 20 milliseconds).

In some embodiments, the on-board controller 16 can filter the actual power consumption 202 using a fast low-pass filter to obtain the current power consumption 204. The current power consumption 204 can represent the actual power consumption 202; however, the current power consumption 204 can be substantially smoother than the actual power consumption 202. This type of signal filtering can result in "fast detection" (also referred to as "dynamic detection") of any obstructions in the pumping system (e.g., based on dynamic behavior of the shaft power when the inlet 18 is blocked suddenly). In some embodiments, the fast low-pass filter can have a time constant of about 200 milliseconds.

In some embodiments, the on-board controller 16 can filter the signal for the actual power consumption 202 using a slow low-pass filter to obtain the lagged power consumption 206. The lagged power consumption 206 can represent the actual power consumption from an earlier time period. If the inlet 18 is obstructed at the time instance 200, the actual power consumption 202 will rapidly drop. The current power consumption 204 can substantially follow the drop of the actual power consumption 202. However, the lagged power consumption 206 will drop substantially slower than the actual power consumption 202. As a result, the lagged power consumption 206 will generally be higher than the actual power consumption 202. This type of signal filtering can result in "slow detection" (also referred to as "dead head detection" or "static detection") of any obstructions in the pumping system (e.g., when there is an obstruction in the pumping system and the pool pump 10 runs dry for a few seconds). In some embodiments, the slow low-pass filter can have a time constant of about 1400 milliseconds.

The signal filtering of the actual power consumption 202 can be performed over a time interval of about 2.5 seconds, resulting in a reaction time between about 2.5 seconds and about 5 seconds, depending on when the dead head condition occurs during the signal filtering cycle. In some embodiments, the static detection can have a 50% sensitivity which can be defined as the power consumption curve calculated from a minimum measured power plus a 5% power offset at all speeds from about 1500 RPM to about 3450 RPM. When the sensitivity is set to 0%, the static detection can be disabled.

FIG. 5B illustrates a relative power consumption curve 208 of the pool pump 10 for the same scenario of FIG. 5A. In some embodiments, the relative power consumption can be computed by calculating the difference between the current power consumption 204 and the lagged power consumption 206 (i.e., the "absolute power variation") divided by the current power consumption 204. The greater the difference between the time constants of the fast and slow filters, the higher the time frame for which absolute power variation can be calculated. In some embodiments, the absolute power variation can be updated about every 20 milliseconds for dynamic detection of obstructions in the pumping system. Due to the lagged power consumption 206 being higher than the current power consumption 204, a negative relative power consumption 208 can be used by the SVRS of the on-board controller 16 to identify an obstructed inlet 18.

The relative power consumption 208 can also be used to determine a "relative power variation" (also referred to as a "power variation percentage"). The relative power variation can be calculated by subtracting the lagged power consumption 206 from the current power consumption 204 and dividing by the lagged power consumption 206. When the inlet 18 is blocked, the relative power variation will be negative as shaft power decreases rapidly in time. A negative threshold can be set for the relative power variation. If the relative power variation exceeds the negative threshold, the SVRS can identify an obstructed inlet 18 and shut down the pool pump 10 substantially immediately. In one embodiment, the negative threshold for the relative power variation can be provided for a speed of about 2200 RPM and can be provided as a percentage multiplied by ten for increased resolution. The negative threshold for other speeds can be calculated by assuming a second order curve variation and by multiplying the percentage at 800 RPM by six and by multiplying the percentage at 3450 RPM by two. In some embodiments, the sensitivity of the SVRS can be altered by changing the percentages or the multiplication factors.

In some embodiments, the on-board controller 16 can include a dynamic counter. In one embodiment, a dynamic counter value 210 can be increased by one value if the absolute power variation is negative. The dynamic counter value 210 can be decreased by one value if the absolute power variation is positive. In some embodiments, if the dynamic counter value 210 is higher than a threshold (e.g., a value of about 15 so that the counter needs to exceed 15 to trigger an obstructed inlet alarm), a dynamic suction blockage is detected and the pool pump 10 is shut down substantially immediately. The dynamic counter value 210 can be any number equal to or greater than zero. For example, the dynamic counter value 210 may remain at zero indefinitely if the shaft power continues to increase for an extended time period. However, in the case of a sudden inlet blockage, the dynamic counter value 210 will rapidly increase, and once it increases beyond the threshold value of 15, the pool pump 10 will be shut down substantially immediately. In some embodiments, the threshold for the dynamic counter value 210 can depend on the speed of the motor 14 (i.e., the thresholds will follow a curve of threshold versus motor speed). In one embodiment, the dynamic detection can monitor shaft power variation over about one second at a 20 millisecond sampling time to provide fast control and monitoring. FIG. 5C illustrates the dynamic counter value 210 of the dynamic counter for the relative power consumption 208 of FIG. 5B.

Figure 5D:
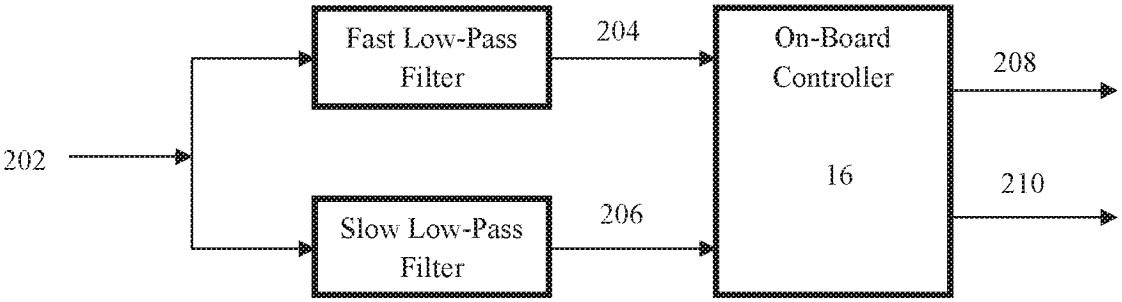
FIG. 5D is a flow chart of a method for calculating a relative power consumption and a dynamic counter value for a pool pump.

FIG. 5D depicts the aforementioned steps for providing the relative power consumption 208 and the dynamic counter value 210 by the on-board controller 16. The relative power consumption 208 and the dynamic counter value 210 can be used to determine an obstructed inlet 18. For example, in one embodiment, the SVRS can determine that there is an obstructed inlet 18 when both of the following events occur: (1) the relative power variation exceeds a negative threshold; and (2) the dynamic counter value 210 exceeds a positive threshold (e.g., a value of 15). When both of these events occur, the on-board controller 16 can shut down the pool pump 10 substantially immediately. However, in some embodiments, one of these thresholds can be disabled. The relative power variation threshold can be disabled if the relative power variation threshold needs only to be negative to trigger the obstructed inlet alarm. Conversely, the dynamic counter can be disabled if the dynamic counter value needs only to be positive to trigger the obstructed inlet alarm.

The on-board controller 16 can evaluate the relative power consumption 208 in a certain time interval. The on-board controller 16 can adjust the dynamic counter value 210 of the dynamic counter for each time interval. In some embodiments, the time interval can be about 20 milliseconds. In some embodiments, the on-board controller 16 can trigger the SVRS based on one or both of the relative power consumption 208 and the dynamic counter value 210 of the relative counter. The values for the relative power consumption 208 and the dynamic counter value 210 when the on-board controller 16 triggers the SVRS can be programmed into the on-board controller 16.

Figure 6:
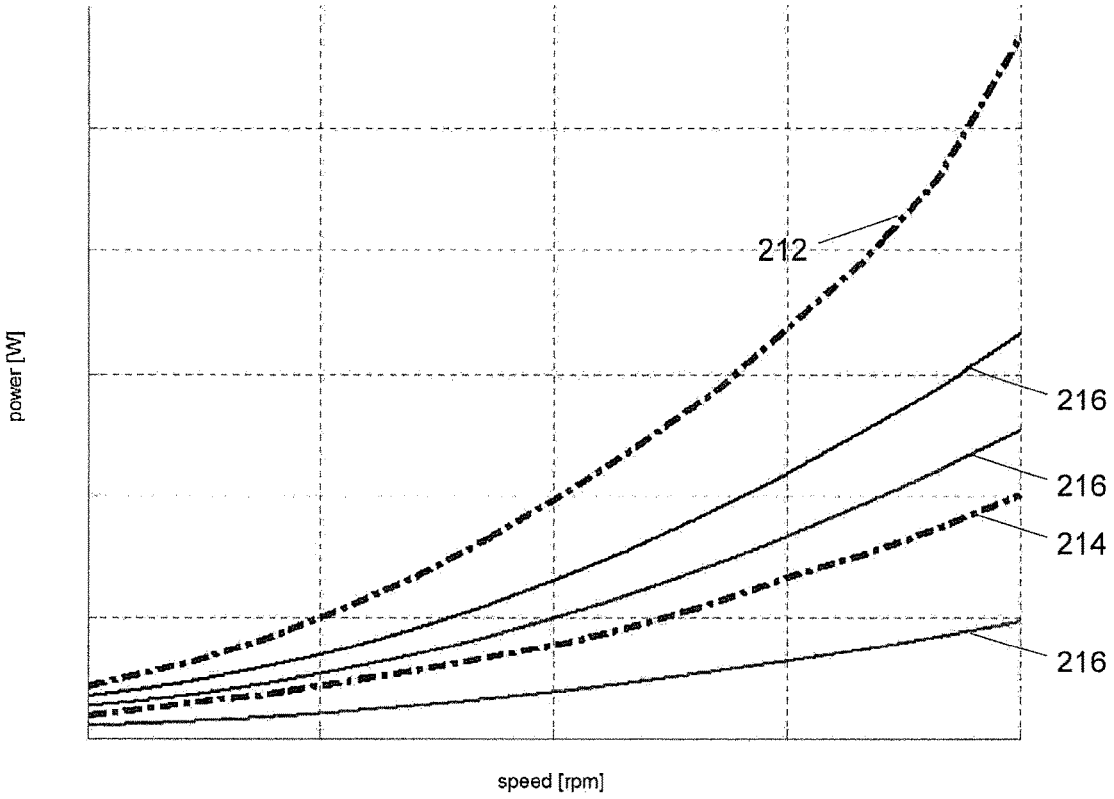
FIG. 6 is a graph of a power consumption versus the speed of the pool pump according to one embodiment of the invention.

FIG. 6 illustrates a maximum power consumption curve 212 and a minimum power consumption curve 214 versus the speed of the pool pump 10 according to one embodiment of the invention. In some embodiments, the maximum power consumption curve 212 and/or the minimum power consumption curve 214 can be empirically determined and programmed into the on-board controller 16. The maximum power consumption curve 212 and the minimum power consumption curve 214 can vary depending on the size of the piping system coupled to the pool pump 10 and/or the size of the aquatic applications. In some embodiments, the minimum power consumption curve 214 can be defined as about half the maximum power consumption curve 212.

FIG. 6 also illustrates several intermediate power curves 216. The maximum power consumption curve 212 can be scaled with different factors to generate the intermediate power curves 216. The intermediate power curve 216 resulting from dividing the maximum power consumption curve 212 in half can be substantially the same as the minimum power consumption curve 214. The scaling factor for the maximum power consumption 212 can be programmed into the on-board controller 16. One or more of the maximum power consumption 212 and the intermediate power curves 216 can be used as a threshold value to detect an obstructed inlet 18. In some embodiments, the on-board controller 16 can trigger the SVRS if one or both of the actual power consumption 202 and the current power consumption 204 are below the threshold value.

In some embodiments, the on-board controller 16 can include an absolute counter. If the actual power consumption 202 and/or the current power consumption 204 is below the threshold value, a value of the absolute counter can be increased. A lower limit for the absolute counter can be set to zero. In some embodiments, the absolute counter can be used to trigger the SVRS. The threshold value for the absolute counter before the SVRS is activated can be programmed into the on-board controller 16. In some embodiments, if the absolute counter value is higher than a threshold (e.g., a value of about 10 so that the counter needs to exceed 10 to trigger an obstructed inlet alarm), a dead head obstruction is detected and the pool pump 10 is shut down substantially immediately. In other words, if the actual power consumption 202 stays below a threshold power curve (as described below) for 10 times in a row, the absolute counter will reach the threshold value of 10 and the obstructed inlet alarm can be triggered for a dead head condition.

For use with the absolute counter, the threshold value for the actual power consumption 202 can be a threshold power curve with a sensitivity having a percentage multiplied by ten. For example, a value of 500 can mean 50% sensitivity and can correspond to the measured minimum power curve calculated using second order approximation. A value of 1000 can mean 100% sensitivity and can correspond to doubling the minimum power curve. In some embodiments, the absolute counter can be disabled by setting the threshold value for the actual power consumption 202 to zero. The sensitivity in most applications can be above 50% in order to detect a dead head obstruction within an acceptable time period. The sensitivity in typical pool and spa applications can be about 65%.

In some embodiments, the SVRS based on the absolute counter can detect an obstructed inlet 18 when the pool pump 10 is being started against an already blocked inlet 18 or in the event of a slow clogging of the inlet 18. The sensitivity of the SVRS can be adjusted by the scaling factor for the maximum power consumption 212 and/or the value of the absolute counter. In some embodiments, the absolute counter can be used as an indicator for replacing and/or cleaning the strainer 42 and/or other filters installed in the piping system of the aquatic applications.

In some embodiments, the dynamic counter and/or the absolute counter can reduce the number of nuisance trips of the SVRS. The dynamic counter and/or the absolute counter can reduce the number of times the SVRS accidently shuts down the pool pump 10 without the inlet 18 actually being obstructed. A change in flow rate through the pool pump 10 can result in variations in the absolute power consumption 202 and/or the relative power consumption 208 that can be high enough to trigger the SVRS. For example, if a swimmer jumps into the pool, waves can change the flow rate through the pool pump 10 which can trigger the SVRS, although no blockage actually occurs. In some embodiments, the relative counter and/or the absolute counter can prevent the on-board controller 16 from triggering the SVRS if the on-board controller 16 changes the speed of the motor 14. In some embodiments, the controller 16 can store whether the type of obstructed inlet was a dynamic blocked inlet or a dead head obstructed inlet.

The actual power consumption 202 varies with the speed of the motor 14. However, the relative power consumption 208 can be substantially independent of the actual power consumption 202. As a result, the power consumption parameter of the motor shaft 56 by itself can be sufficient for the SVRS to detect an obstructed inlet 18 over a wide range of speeds of the motor 14. In some embodiments, the power consumption parameter can be used for all speeds of the motor 14 between the minimum speed setting 124 and the maximum speed setting 126. In some embodiments, the power consumption values can be scaled by a factor to adjust a sensitivity of the SVRS. A technician can program the power consumption parameter and the scaling factor into the on-board controller 16.

Figure 7:
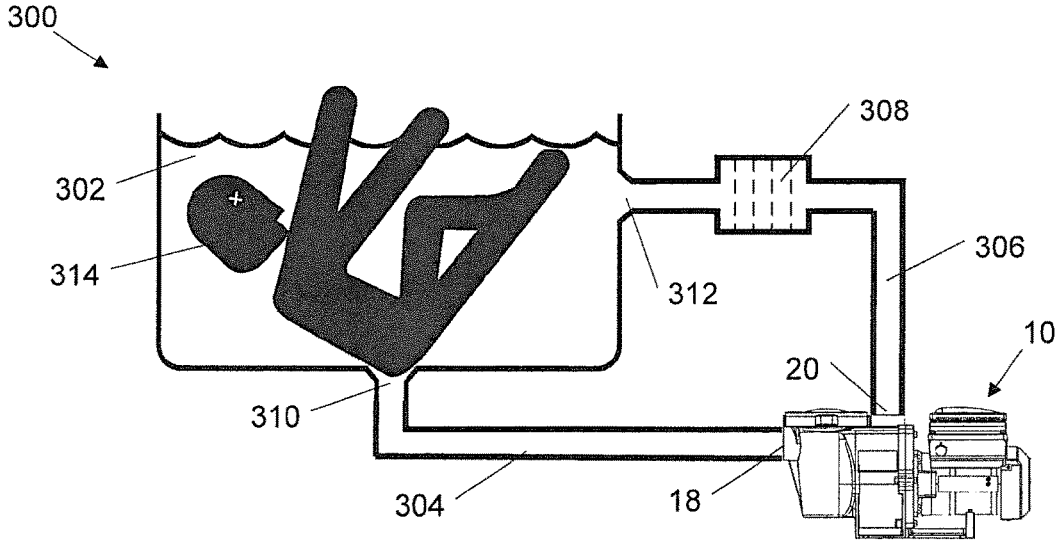
FIG. 7 is a schematic illustration of a pool system with a person blocking a water outlet of the pool.

FIG. 7 illustrates a pool or spa 300 with a vessel 302, an outlet pipe 304, an inlet pipe 306, and a filter system 308 coupled to the pool pump 10. The vessel 302 can include an outlet 310 and an inlet 312. The outlet pipe 304 can couple the outlet 310 with the inlet 18 of the pool pump 10. The inlet pipe 306 can couple the outlet 20 of the pool pump 10 with the inlet 312 of the vessel 302. The inlet pipe 306 can be coupled to the filter system 308.

An object in the vessel 302, for example a person 314 or a foreign object, may accidently obstruct the outlet 310 or the inlet 18 may become obstructed over time. The on-board controller 16 can detect the blocked inlet 18 of the pool pump 10 based on one or more of the actual power consumption 202, the current power consumption 204, the relative power consumption 208, the dynamic counter, and the absolute counter. In some embodiments, the on-board controller 16 can trigger the SVRS based on the most sensitive (e.g., the earliest detected) parameter. Once an obstructed inlet 18 has been detected, the SVRS can shut down the pool pump 10 substantially immediately. The on-board controller 16 can illuminate an LED 96 on the user interface 60 and/or can activate an audible alarm. In some embodiments, the on-board controller 16 can restart the pool pump 10 automatically after the time period for the SVRS automatic restart 128 has elapsed. In some embodiments, the on-board controller 16 can delay the activation of the SVRS during start up of the pool pump 10. In some embodiments, the delay can be about two seconds.

If the inlet 18 is still obstructed when the pool pump 10 is restarted, the SVRS will be triggered again. Due to the pool pump 10 being started against an obstructed inlet 18, the relative power consumption 208 may be inconclusive to trigger the SVRS. However, the on-board controller 16 can use the actual power consumption 202 and/or the current power consumption 204 to trigger the SVRS. In some embodiments, the SVRS can be triggered based on both the relative power consumption 208 and the actual power consumption 202.

In some embodiments, the SVRS can be triggered for reasons other than the inlet 18 of the pool pump 10 being obstructed. For example, the on-board controller 16 can activate the SVRS if one or more of the actual power consumption 202, the current power consumption 204, and the relative power consumption 208 of the pool pump 10 varies beyond an acceptable range for any reason. In some embodiments, an obstructed outlet 20 of the pool pump 10 can trigger the SVRS. In some embodiments, the outlet 20 may be obstructed anywhere along the inlet pipe 306 and/or in the inlet 312 of the pool or spa 300. For example, the outlet 20 could be obstructed by an increasingly-clogged strainer 42 and/or filter system 308.

In some embodiments, the number of restarts of the pool pump 10 after time period for the SVRS automatic restart 128 has been elapsed can be limited in order to prevent excessive cycling of the pool pump 10. For example, if the filter system 308 is clogged, the clogged filter system 308 may trigger the SVRS every time the pool pump 10 is restarted by the on-board controller 16. After a certain amount of failed restarts, the on-board controller 16 can be programmed to stop restarting the pool pump 10. The user interface 60 can also indicate the error on the display 62. In some embodiments, the user interface 60 can display a suggestion to replace and/or check the strainer 42 and/or the filter system 308 on the display 62.

It will be appreciated by those skilled in the art that while the invention has been described above in connection with particular embodiments and examples, the invention is not necessarily so limited, and that numerous other embodiments, examples, uses, modifications and departures from the embodiments, examples and uses are intended to be encompassed by the claims attached hereto. The entire disclosure of each patent and publication cited herein is incorporated by reference, as if each such patent or publication were individually incorporated by reference herein. Various features and advantages of the invention are set forth in the following claims.

We claim:

1. A pumping system for at least one aquatic application, the pumping system comprising:

a pump;

a motor coupled to the pump;

a user interface associated with the pump, the user interface configured to receive input instructions from a user; and a controller in communication with the motor, the controller measuring an actual power consumption of the motor, the controller filtering the actual power consumption to obtain a current power consumption;

the controller comparing the current power consumption to a predetermined threshold value, and the controller triggering a safety vacuum release system based on the comparison of the current power consumption and the predetermined threshold value.

2. The pumping system of claim 1, wherein the controller operates the pump according to at least one schedule.

3. The pumping system of claim 1 further including an external controller configured to allow operation of the system from a remote location.

4. The pumping system of claim 1, wherein the controller will automatically restart the pump after an obstructed inlet has been detected and the pump has been stopped.

5. The pumping system of claim 1 further including a counter configured to incrementally increase a counter value based on the comparison of the current power consumption and the predetermined threshold value, and wherein the controller is configured to trigger the safety vacuum release system based on the counter value in addition to the comparison.

6. The pumping system of claim 1, wherein the predetermined threshold value is determined using a power consumption curve.

7. A pumping system comprising a safety vacuum release system for at least one aquatic application, the pumping system comprising:

a pump including an inlet;

a motor coupled to the pump;

a detached controller configured to control operation of the pump; and an on-board controller in communication with the motor, the on-board controller designed to determine an actual power consumption of the motor, the on-board controller filtering the actual power consumption to obtain a current power consumption, and the on-board controller designed to trigger the safety vacuum release system based on only the current power consumption.

8. The pumping system of claim 7, wherein the on-board controller is further configured to:

implement an automatic restart setting that provides a time period before resuming operation of the pump after an obstructed inlet has been detected and the pump has been stopped.

9. The pumping system of claim 7, wherein the on-board controller stores a plurality of motor speeds associated with a plurality of corresponding schedules.

10. A method of operating a pumping system, the pumping system having a pump including a variable speed motor, a safety vacuum release system, and a controller, the method comprising:

measuring an actual power consumption of the motor necessary to pump water;

filtering the actual power consumption with a fast low-pass filter to obtain a current power consumption;

filtering the actual power consumption with a slow low-pass filter to obtain a lagged power consumption;

calculating an absolute power variation by subtracting the lagged power consumption from the current power consumption;

calculating a relative power variation by dividing the absolute power variation by the lagged power consumption;

triggering the safety vacuum release system when the relative power variation is less than a negative threshold.

11. The method of claim 10, wherein if the relative power variation is not less than a negative threshold, but less than 0, a dynamic counter is increased.

12. The method of claim 11, further comprising triggering the safety vacuum release system when the dynamic counter is greater than a pre-defined threshold.

13. The method of claim 12, wherein the pre-defined threshold is 15.

14. The method of claim 10, wherein the fast low-pass filter has a time constant of about 200 milliseconds and the slow low-pass filter has a time constant of about 1400 milliseconds.

15. A method of operating a pumping system, the pumping system having a pump including a variable speed motor, a safety vacuum release system, and a controller, the method comprising:

measuring an actual power consumption of the motor;

filtering the actual power consumption with a fast low-pass filter to obtain a current power consumption;

incrementing an absolute counter value if at least one of the actual power consumption and the current power consumption is less than a threshold power curve;

identifying a dead head condition if the absolute counter value exceeds an absolute counter threshold value; and triggering the safety vacuum release system when the dead head condition is identified in order to shut down the pump substantially immediately.

16. The method of claim 15 and further comprising:

calculating an absolute power variation based on the actual power consumption;

incrementing a dynamic counter value if the absolute power variation is negative;

calculating a relative power variation based on the actual power consumption;

identifying a dynamic suction blockage if at least one of the dynamic counter value exceeds a dynamic counter threshold value and the relative power variation is below a negative threshold.

17. The method of claim 15 wherein the fast low-pass filter has a time constant of about 200 milliseconds.

18. The method of claim 15 wherein the actual power consumption is filtered for about 2.5 seconds.

19. The method of claim 16 wherein the absolute power variation is updated about every 20 milliseconds to provide dynamic suction blockage detection.

20. The method of claim 16 and further comprising calculating a relative power consumption by dividing the absolute power variation by the current power consumption.

21. The method of claim 15 wherein the absolute counter threshold value is 10.

22. The method of claim 15 and further comprising restarting the pump after a time period has elapsed.

23. The method of claim 22 and further comprising preventing the pump from being restarted if the dead head condition is identified again.

24. The method of claim 16 wherein the dynamic counter threshold value is 15.

* * * * *